US007690238B2

(12) United States Patent
Shiroza

(10) Patent No.: US 7,690,238 B2
(45) Date of Patent: Apr. 6, 2010

(54) WORK CARRYING DEVICE OF PRESSING MACHINE

(75) Inventor: Kazuhiko Shiroza, Komatsu (JP)

(73) Assignee: Komatsu Ltd., Tokyo (JP)

( * ) Notice: Subject to any disclaimer, the term of this patent is extended or adjusted under 35 U.S.C. 154(b) by 654 days.

(21) Appl. No.: 10/576,673

(22) PCT Filed: Oct. 22, 2004

(86) PCT No.: PCT/JP2004/015739

§ 371 (c)(1),
(2), (4) Date: Jan. 8, 2007

(87) PCT Pub. No.: WO2005/039801

PCT Pub. Date: May 6, 2005

(65) Prior Publication Data

US 2008/0034988 A1 Feb. 14, 2008

(30) Foreign Application Priority Data

Oct. 23, 2003 (JP) ..... 2003-363110
Oct. 29, 2003 (JP) ..... 2003-368431
Oct. 22, 2004 (JP) ..... 2004-308785
Oct. 22, 2004 (JP) ..... 2004-308786

(51) Int. Cl.
*B21J 11/00* (2006.01)

(52) U.S. Cl. ..... 72/405.11; 72/405.16

(58) Field of Classification Search . 72/405.11–405.16, 72/405.05; 198/621.1, 468.01, 468.4, 468.6, 198/468.8, 468.9
See application file for complete search history.

(56) References Cited

U.S. PATENT DOCUMENTS 4,540,087 A * 9/1985 Mizumoto ..... 198/621.1
5,782,129 A * 7/1998 Vanderzee et al. ..... 72/405.1
6,050,124 A 4/2000 Shiroza
2002/0144533 A1 10/2002 Shiroza

FOREIGN PATENT DOCUMENTS

DE 199 02 988 B4 4/2007

(Continued)

OTHER PUBLICATIONS

A Japanese language International Preliminary Report on Patentability (IPRP), Chapter I of the Patent Cooperation Treaty, and Written Opinion dated Apr. 24, 2006, for PCT/JP2004/015739, 5 sheets.

(Continued)

*Primary Examiner*—Dana Ross
*Assistant Examiner*—Stephanie Jennings
(74) *Attorney, Agent, or Firm*—Frishauf, Holtz, Goodman & Chick, P.C.

(57) ABSTRACT

A transfer feeder 41 has a lift/clamp device 80 moving a bar 14 in a lift direction and a clamp direction, a plurality of feed carriers 52 installed on the bar 14, and feeding linear motors 53 driving the feed carriers 52 in a feed direction. Since an object driven by the feeding linear motors 53 can be formed small since the feed carriers 52 are installed on the bar 14, the feeding linear motors 53 having a small capacity can be adopted to simplify the structure of a transfer press 1.

8 Claims, 27 Drawing Sheets

FOREIGN PATENT DOCUMENTS

| | | | |
|---|---|---|---|
| JP | 56-026638 | A | 3/1981 |
| JP | 60-136830 | U | 9/1985 |
| JP | 5-200464 | A | 8/1993 |
| JP | 20473/1993 | | 10/1994 |
| JP | 07-030180 | Y2 | 7/1995 |
| JP | 10-180377 | A | 7/1998 |
| JP | 11-057899 | A | 3/1999 |
| JP | 11-221636 | A | 8/1999 |
| JP | 2002-102964 | A | 4/2002 |
| JP | 2002-126838 | A | 5/2002 |
| JP | 2002-307116 | A | 10/2002 |
| JP | 2002-346667 | A | 12/2002 |
| JP | 2003-290851 | A | 10/2003 |

OTHER PUBLICATIONS

An English language translation of the International Preliminary Report on Patentability (IPRP), Chapter I of the Patent Cooperation Treaty, and Written Opinion, dated Jul. 27, 2006 for PCT/JP2004/015739, 5 sheets.

Japanese Office Action (and English translation thereof) dated Aug. 26, 2008, issued in a counterpart Japanese Application.

* cited by examiner

WORK CARRYING DEVICE OF PRESSING MACHINE

This application is a U.S. National Phase Application under 35 USC 371 of International Application PCT/JP2004/015739 filed Oct. 22, 2004.

TECHNICAL FIELD

The present invention relates to a work carrying device of pressing machine.

BACKGROUND ART

FIG. 27 shows a transfer press 100 as a conventional pressing machine. As shown in FIG. 17, four uprights 121 are erected on a bed 123 located in a lower portion of a press frame 110 of the transfer press 100, and a crown 120 is provided above the uprights 121. A slide drive device is built into the crown 120 for driving a slide 122 disposed below the crown 120 upward and downward. Upper dies 112 are attached to a lower surface of the slide 122. Lower dies 113 are attached to an upper surface of a moving bolster 130 opposed to the slide 122, so that a work is press-formed by cooperation of the upper dies 112 with the lower dies 113. A pair of transfer bars 114, 114 are provided on the right and left with the upper dies 112 and the lower dies 113 sandwiched therebetween, the pair of bars 114, 114 extending in parallel. The transfer bars 114, 114 are provided with fingers (not shown) faced to each other for holding a work (not shown). By appropriately reciprocating the transfer bars 114, 114 in a feed direction, a lift direction and a clamp direction, the work is sequentially transferred from the lower die 113 on an upstream side (the left side in FIG. 27) to the lower die 113 on a downstream side (the right side in FIG. 27). Incidentally, the feed direction means the direction in parallel with the work transfer direction, and motions in the feed direction include an advance motion (i.e., a motion from the upstream side toward the downstream side) and a return motion (a motion from the downstream side toward the upstream side). Further, the lift direction means vertical direction, and motions in the lift direction include a lift motion (i.e., a motion from the lower side to the upper side) and a down motion (i.e., a motion from the upper side to the lower side). Further, the clamp direction means a horizontal direction perpendicular to the feed direction (i.e., the direction vertical to the paper surface in the FIG. 27), and motions in the clamp direction include a clamp motion (i.e., a motion for decreasing the distance between two transfer bars 114) and an unclamp motion (i.e., a motion for increasing the distance between two transfer bars 114).

Further, in the case of a three-dimensional transfer feeder, by repeating clamp operation, lift operation, advance operation, down operation, unclamp operation and return operation to the transfer bar 114, the work is sequentially transferred to the lower die 113 on the downstream side.

A feed drive section 115 for moving the transfer bar 114 in the feed direction is fixed on the lateral surface of the press frame 110 on the upstream side (or the downstream side). A clamp drive section 116, which moves the transfer bar 114 in the clamp direction, and a lift drive section 117, which moves the transfer bar 114 in the lift direction, are provided on the bed 123 between the two uprights 121 on the upstream side and the two uprights 121 on the downstream side.

The feed drive section 115, the clamp drive section 116, and the lift drive section 117 respectively rotate a feed cam, a clamp cam and a lift cam with the rotating power fetched from the press main body, so that the transfer bar 114 is driven by these cams to perform three-dimensional motion in the feed direction, the clamp direction, and the lift direction.

However, in the case of the movements in the feed direction, the clamp direction, and the lift direction are driven by the respective cams, to obtain a variable motion pattern of the transfer bar 114, plural cams are needed according to the motion pattern, therefore not only the drive mechanism becomes complicated and expensive, but also the variable motion pattern is limited by the number of the cams. Thus recently there is a desire to easily obtain various motion patterns with a simple drive mechanism.

Thus a work carrying device is proposed, of which the feed drive section 115, the clamp drive section 116, and the lift drive section 117 are driven by respective servomotors, and the servomotors are controllable.

The feed drive section 115, the clamp drive sections 116, and the lift drive section 117, all these driving by means of servomotors, have the following configuration. The feed drive section 115 is provided with a ball screw mechanism, which uses a first servomotor as driving source, for reciprocating the transfer bar 114 in the feed direction. The clamp drive section 116 is provided with a ball screw mechanism, which uses a second servomotor as driving source, for reciprocating the transfer bar 114 in the clamp direction. The lift drive section 117 is provided with a rack and pinion mechanism, which uses a third servomotor as driving source, for reciprocating the transfer bar 114 in the lift direction.

Further, as described in Patent Document 1, all of the feed operation, the clamp operation, and the lift operation of the feed bar also can be driven by linear motors. In such a work carrying device, the feed bar is suspended from a bracket fixed to the press main body. The linear motor is provided between the bracket and the feed bar, and the feed bar moves in the feed direction relative to the bracket so as to perform the feed operation. Also, the clamp operation and the lift operation are driven by respective linear motors provided on the lower surface of the feed bar.

Further, Patent Document 2 describes a work carrying device in which a fixed bar is provided with a first bracket which is driven by a linear motor so as to perform lift operation, the first bracket is provided with a second bracket which is driven by a linear motor so as to perform clamp operation, and the second bracket is provided with a third bracket with a work holder installed thereon, the third bracket being driven by a linear motor so as to perform feed operation.

Further, Patent Document 3 describes a work carrying device having a pair of lift beams arranged in parallel in the work transfer direction and capable of being freely moved in the vertical direction, a carrier provided on each lift beam and capable of being moved in the longitudinal direction of the lift beam by means of a linear motor, sub-carriers provided on the carrier and capable of being moved along a guide of the carrier in the carrier moving direction by means of a linear motor; and a cross bar spanning over the pair of oppositely facing sub-carriers and having a work holder. In such a work carrying device, the lift operation is performed by moving the lift beams by means of a servomotor. Further, the feed operation is performed by moving the carrier and the sub-carriers in the feed direction by means of a linear motor. Owing to the carrier and the sub-carriers, the moving range in the feed direction can be widened.

[Patent Document 1] Japanese Patent Laid-Open Publication No. Hei10-314871 (Page 4 and FIG. 5)

[Patent Document 2] Japanese Patent Laid-Open Publication No. Hei11-104759 (Pages 2 to 3, FIG. 3, and FIG. 4)

[Patent Document 3] Japanese Patent Laid-Open Publication No. 2003-205330 (Page 5 and FIG. 5)

DISCLOSURE OF THE INVENTION

Problems to be Solved by the Invention

However, in the conventional transfer press as shown in FIG. 27, since the feed box with the feed drive section 115 housed therein is arranged on a lateral surface of the press main body, and since a lift box and a clamp box, respectively having the lift drive section 117 and the clamp drive section 116 housed therein, are arranged between the right and left uprights 121, not only the drive mechanism becomes complicated, but also the manufacturing cost is increased.

Further, since the feed box with the feed drive section 115 housed therein projects outwardly from the lateral surface of the press main body, not only it can be obstructive in the case where a material supply device or a work carrying-out device is wanted to be installed, but also a wide installation space is required for press line.

Further, with the art described in Patent Document 1, since the feed bar in its entirety is driven in the feed direction, the total weight to be driven becomes large. Thus a driving source having larger capacity is necessary to follow the production speed of pressing, so that the manufacturing cost is increased.

Further, with the art described in Patent Document 2, since the second bracket is provided with a third bracket which performs feed operation driven by a linear motor, the length of the second bracket in the feed direction has to be large to ensure feed distance. Thus the second bracket becomes large and heavy, and the second bracket has to perform clamp operation relative to the first bracket. Further, the first bracket, which holds the second bracket, has to perform lift operation relative to the fixed bar. Thus linear motors having larger capacity will necessarily be used for the driving mechanism for performing clamp operation and lift operation, so that the manufacturing cost is increased.

Further, with the art described in Patent Document 3, though the moving range in the feed direction can be widened, a carrier capable of being moved by a linear motor and sub-carriers capable of being moved by a linear motor will be necessary. Thus the number of the linear motor for feeding the work is increased, therefore not only the construction becomes complicated, but also the manufacturing cost is increased.

As according to the above, though the servomotor or other methods are employed, the effect for simplifying the construction is not enough, simplified construction and reduced cost are further desired.

In view of the aforementioned problems, it is an object of the present invention to provide a work carrying device of pressing machine having simple structure.

Means for Solving the Problems

In order to solve the aforementioned problems, according to a first aspect of the present invention, it is provided a work carrying device of pressing machine which includes: frames provided on both sides of a moving bolster in a work transfer direction; a pair of bars provided in parallel in the work transfer direction; a feed carrier held by each of the bars; a feed drive mechanism provided on each of the bars, the feed drive mechanism driving the feed carrier in the work transfer direction; a lift drive mechanism provided in each of the frames, the lift drive mechanism driving the pair of bars in a lift direction so that the bars moves vertically; a clamp drive mechanism provided in each of the frames, the clamp drive mechanism driving the pair of bars in a clamp direction perpendicular to the work transfer direction; and a work holder detachably attached to the feed carrier for holding a work.

According to a second aspect of the present invention, in the work carrying device of pressing machine according to the first aspect of the present invention, the feed drive mechanism is provided with a linear motor.

According to a third aspect of the present invention, in the work carrying device of pressing machine according to the first aspect of the present invention, the feed drive mechanism is provided with a servomotor.

According to a fourth aspect of the present invention, in the work carrying device of pressing machine according to any one of the first to third aspects of the present invention, a plurality of the work holders for plural working processes are detachably attached to the feed carrier.

According to a fifth aspect of the present invention, in the work carrying device of pressing machine according to any one of the first to fourth aspects of the present invention, the pair of bars include fixed bars supported by the lift drive mechanism or the clamp drive mechanism, and movable bars capable of being detached from the fixed bars.

According to a sixth aspect of the present invention, it is provided a work carrying device of pressing machine which includes: a pair of bars supported by frames provided on both sides of a moving bolster in a work transfer direction, the pair of bars being arranged in parallel in the work transfer direction; a feed carrier held by the bars; a feed drive mechanism provided on each of the bars, the feed drive mechanism driving the feed carrier in the work transfer direction; a base held by the feed carrier; a lift drive mechanism provided on the feed carrier, the lift drive mechanism driving the base in a lift direction so that the base moves vertically; and a work holder detachably attached to the base for holding a work.

According to a seventh aspect of the present invention, the work carrying device of pressing machine according to the sixth aspect of the present invention is further provided with a clamp drive mechanism provided on the feed carrier, the clamp drive mechanism driving the base in a clamp direction perpendicular to the work transfer direction.

According to an eighth aspect of the present invention, in the work carrying device of pressing machine according to the sixth or seventh aspect of the present invention, at least one of the feed drive mechanism and the lift drive mechanism is provided with a linear motor.

According to a ninth aspect of the present invention, in the work carrying device of pressing machine according to the seventh aspect of the present invention, the clamp drive mechanism is provided with a linear motor.

According to a tenth aspect of the present invention, in the work carrying device of pressing machine according to the sixth or seventh aspect of the present invention, at least one of the feed drive mechanism and the lift drive mechanism is provided with a servomotor.

According to an eleventh aspect of the present invention, in the work carrying device of pressing machine according to the seventh aspect of the present invention, the clamp drive mechanism is provided with a servomotor.

According to a twelfth aspect of the present invention, in the work carrying device of pressing machine according to any one of the sixth aspect to eleventh aspect of the present invention, a plurality of the work holders for plural working processes are detachably attached to the base.

According to a thirteenth aspect of the present invention, the work carrying device of pressing machine according to any one of the sixth to twelfth aspects of the present invention is further provided with a bar-interval adjusting device for adjusting an interval between the pair of bars.

According to a fourteenth aspect of the present invention, in the work carrying device of pressing machine according to any one of the sixth to thirteenth aspects of the present invention, the pair of bars can be detached from the frames.

According to a fifteenth aspect of the present invention, in the work carrying device of pressing machine according to any one of the first to fourteenth aspects of the present invention, a plurality of the feed carriers are held by each of the bars, a motion of the each feed carrier being individually controllable.

According to a sixteenth aspect of the present invention, in the work carrying device of pressing machine according to any one of the first to fourteenth aspects of the present invention, a plurality of the feed carriers are held by each of the bars, adjacent ones of the plurality of the feed carriers being connected to each other by a connector.

EFFECT OF THE INVENTION

According to the first aspect of the present invention, the pair of bars are respectively driven by the lift drive mechanism in the lift direction and driven by the clamp drive mechanism in the lift direction. Further, the feed carrier held by the bar is driven by the feed drive mechanism to move relative to the bar in the feed direction. By these operations, the work carrying device of pressing machine moves the work holder in three dimensions. The motion of the work holder in the feed direction (which requires a long stroke) is performed by the feed drive mechanism directly provided on the bar.

With such an arrangement, since the feed drive mechanism, which requires a long stroke, is provided on the bar, the feed drive mechanism can be compactly installed in the press main body.

Since a feed device (a feed box) projected from the press main body on the downstream side (or the upstream side) for moving a conventional bar itself in the feed direction is eliminated, the pressing machine as a whole can be downsized. Further, since the feed drive mechanism only needs to have a driving force necessary for driving the feed carrier, the feed drive mechanism with small capacity can be used. Thus the construction of the work carrying device can be simplified.

Herein, the feed direction means a direction parallel to the work transfer direction, the lift direction means a direction perpendicular to a plane including the pair of the bars, and the clamp direction means a horizontal direction perpendicular to the work transfer direction, namely a direction in which the pair of bars move toward or away from each other.

Note that the case of installing the feed drive mechanism on the bar not only includes the case where the feed drive mechanism is directly installed on the bar by attachment or the like, but also includes the case where the feed drive mechanism is indirectly installed through a member attached on the bar.

According to the second aspect of the present invention, since the feed drive mechanism is provided with the linear motor, non-contact movement becomes possible, and also since the there is no rotating portion, not only the endurance of the work carrying device can be improved, but also driving noise can be reduced. Further, since the linear motor is employed, not only wide installation space for the feed drive mechanism becomes unnecessary, but also high-speed carry and high-precision positioning can be realized. Further, since the linear motor has fewer components including no rotating component, the feed drive mechanism can be made small in size and light in weight.

According to the third aspect of the present invention, since the feed drive mechanism is provided with a servomotor, the cost for the feed drive mechanism is reduced, and since the conventional mechanism such as a ball screw mechanism, a rack and pinion mechanism or the like can be used for the power transmitting mechanism, maintenance and adjustment of the work carrying device and the pressing machine become easy.

According to the fourth aspect of the present invention, since a plurality of the work holders for plural processes are detachably attached to one feed carrier, in a transfer press having plural working processes, for example, the number of the feed carriers can be reduced, therefore the cost can be reduced. Thus the construction and control can be further simplified.

According to the fifth aspect of the present invention, since the pair of bars include fixed bars and movable bars, the movable bars can detached from the frames. Thus the movable bar can be detached so as to be moved out from the work transfer area when performing die changing, so that the work holder becomes easy to change, and die changing operation can be facilitated.

According to the sixth aspect of the present invention, the feed carrier is driven by the feed drive mechanism so as to move relative to the pair of the bars in the work transfer direction. Further, the base is driven by the lift drive mechanism so as to move relative to the feed carrier in the lift direction. Thus the work carrying device can perform at least two-dimensional motion in the work transfer direction and the lift direction.

Since the feed carrier moves relative to the bars in the work transfer direction, the moving range of feed carrier the in the work transfer direction becomes wide. Also, since the moving distance in the lift direction is usually smaller than the moving distance in the work transfer direction, the length of the feed carrier in the lift direction becomes small. Thus the feed carrier can be made small and light, and the feed drive mechanism and lift drive mechanism with small capacity can be used, therefore it becomes possible to install the feed drive mechanism and lift drive mechanism on the bar and the feed carrier.

Accordingly, different from the conventional art, since the feed box having a feed drive section housed therein becomes unnecessary, there is no feed box projected from the pressing machine body, so that the press device as a whole can be downsized. Further, since no feed box is projected, a work carrying-out device or the like can be provided in the vicinity of the pressing machine. Further, since the lift box, which is arranged together with the feed box between the uprights and has a lift drive section housed therein, also becomes unnecessary, the construction of the work carrying device can be simplified.

Herein the lift direction means a direction perpendicular to a plane including the pair of the bars.

Note that the case of installing the feed drive mechanism on the bar not only includes the case where the feed drive mechanism is directly installed on the bar by attachment or the like, but also includes the case where the feed drive mechanism is indirectly installed through a member attached on the bar.

Also, note that the case of installing the feed drive mechanism on the feed carrier not only includes the case where the lift drive mechanism is directly installed on the feed carrier by attachment or the like, but also includes the case where the lift drive mechanism is indirectly installed through a member attached on the feed carrier.

According to the seventh aspect of the present invention, due to the provision of the clamp drive mechanism for driving the base, the base can move in a clamp direction. Thus the work carrying device can perform three-dimensional motion in the feed direction, the lift direction, and the clamp direction with the feed drive mechanism, the lift drive mechanism, and the clamp drive mechanism. Thus it becomes possible to cope with various kinds of press working, so that versatility of the transfer press can be expanded.

Herein the clamp direction means a horizontal direction perpendicular to the work transfer direction, namely a direction in which the pair of bars move toward or away from each other.

According to the eighth aspect of the present invention, since at least one of the feed drive mechanism and the lift drive mechanism is provided with a linear motor, non-contact movement becomes possible, and also since the there is no rotating portion, not only the endurance of the work carrying device can be improved, but also driving noise can be reduced. Further, since the linear motor is employed, not only wide installation space becomes unnecessary, but also high-speed carry and high-precision positioning can be realized.

According to the ninth aspect of the present invention, since the clamp drive mechanism is provided with the linear motor, non-contact movement becomes possible, and also since there is no rotating portion, not only the endurance of the work carrying device can be improved, but also driving noise can be reduced. Further, since the linear motor is employed, not only wide installation space becomes unnecessary, but also high-speed carry and high-precision positioning can be realized.

According to the tenth aspect of the present invention, since at least one of the feed drive mechanism and the lift drive mechanism is provided with a servomotor, the cost for the feed drive mechanism and/or the lift drive mechanism is reduced, and since the conventional mechanism such as a ball screw mechanism, a rack and pinion mechanism or the like can be used for the power transmitting mechanism, maintenance and adjustment of the work carrying device and the pressing machine become easy.

According to the eleventh aspect of the present invention, since the clamp drive mechanism is provided with a servomotor, the cost for the clamp drive mechanism is reduced, and since the conventional mechanism such as a ball screw mechanism, a rack and pinion mechanism or the like can be used for the power transmitting mechanism, maintenance and adjustment of the work carrying device and the pressing machine become easy.

According to the twelfth aspect of the present invention, since a plurality of the work holders for plural processes are installed to the base, in a transfer press having plural working processes, for example, the number of the feed carrier and the number of the lift carrier and the clamp carrier, both moving together with the feed carrier, can be reduced, therefore the cost can be reduced. Thus the construction and control can be further simplified.

According to the thirteenth aspect of the present invention, due to the provision of the bar-interval adjusting device, the interval between the pair of bars can be adjusted to an optimal value. Further, in the case that the work carrying device has a clamp drive mechanism, when setting a maximum moving distance of the clamp drive mechanism, since the dimension of the bar interval need not to be added to the maximum moving distance (maximum clamp amount), the maximum moving distance of the clamp drive mechanism can be reduced. Thus the weight of the base can be reduced. Further, when exchanging the die mounted on the moving bolster while performing the die exchanging operation in the outside of the pressing machine, since the bar interval can be automatically widened with the bar-interval adjusting device, die exchanging operation is further facilitated.

According to the fourteenth aspect of the present invention, since the pair of bars can be detached from the frames, when performing die changing, the bars can be detached and mounted on the moving bolster so as to be moved out from the work transfer area together with the moving bolster. Thus the work holder becomes easy to change, and die changing operation can be facilitated.

According to the fifteenth aspect of the present invention, since the motion of each feed carrier is individually controllable, the setting such as the moving distance and the moving timing of the feed carrier can be freely set corresponding to the die. Thus it is possible to flexibly cope with various kinds of press working, so that versatility of the transfer press can be expanded.

Further, since the work feed stroke and the feed speed corresponding to a feed position can respectively be set for each feed carrier, optimal feed motion can be obtained for the die of each working process, the pressing machine can be driven at high speed, feed miss can be reduced, and productive efficiency can be improved.

According to the sixteenth aspect of the present invention, since the adjacent feed carriers are connected to each other via a connector, when one feed carrier is driven, other feed carriers connected via the connector will be driven too at the same time in the work transfer direction. Thus it is unnecessary to provide a feed drive mechanism for each of the feed carriers, therefore not only number of components of the feed drive mechanism is reduced so that the cost can be reduced, but also the structure and control can be further simplified.

EXPLANATION OF CODES

1 . . . transfer press (pressing machine), 1A . . . press main body, 2 . . . work, 7 . . . general purpose robot, 11 . . . . die, 12 . . . upper die, 13 . . . lower die, 14, 14A, 14B, 14AA, 14BA . . . bar, 20 . . . crown, 21 . . . upright, 22 . . . slide, 23 . . . bed, 30, 30A . . . moving bolster, 33A, 33B . . . frame, 40, 40A . . . bar-interval adjusting device, 41, 41A, 41B, 41D, 41E, 41F . . . transfer feeder, 53, 53A, 53B, 53C, 53D, 53E . . . feeding linear motor (feed drive mechanism), 56, 56A . . . connector, 52, 52A, 52B, 52C . . . feed carrier, 62, 62A . . . clamp carrier, 63 . . . clamping linear motor (clamp drive mechanism), 63A . . . clamping servomotor (clamp drive mechanism), 72, 72A . . . lift carrier, 73 . . . lifting linear motor (lift drive mechanism), 73A . . . lifting servomotor (lift drive mechanism), 76 . . . finger (work holder), 77 . . . gripper (work holder), 79 . . . vacuum cup (work holder), 80 . . . lift/clamp device, 81 . . . lift device (lift drive mechanism), 82 . . . lift carrier, 83 . . . lift bar, 91 . . . clamp device (clamp drive mechanism), 92 . . . clamp carrier.

BEST MODE FOR CARRYING OUT THE INVENTION

Preferred embodiments of the present invention will be described below with reference to the attached drawings.

First Embodiment

A first embodiment of the present invention will be described below.

Figure 1:
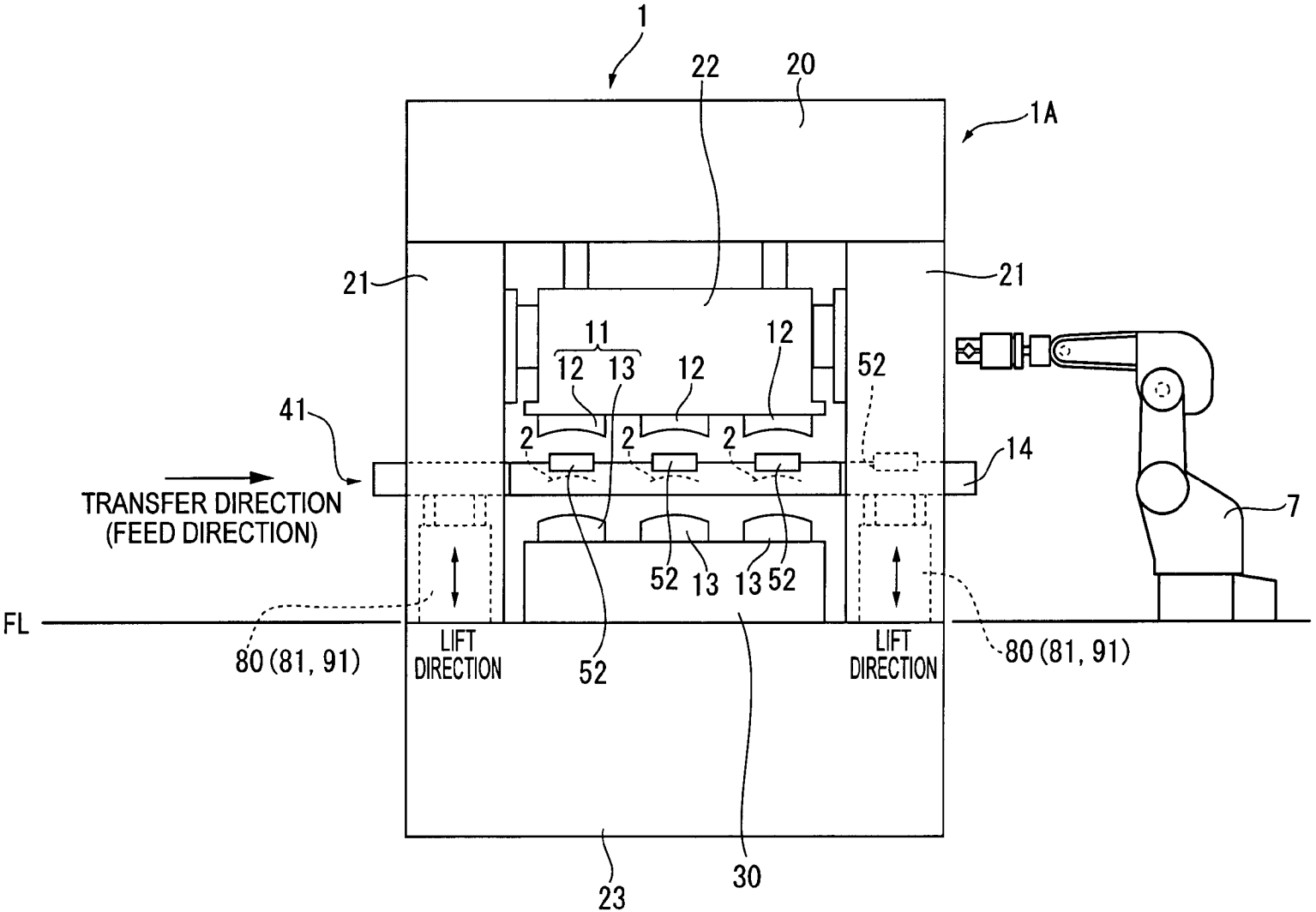
FIG. 1 is a front elevational view showing a pressing machine according to a first embodiment of the present invention.
Figure 2:
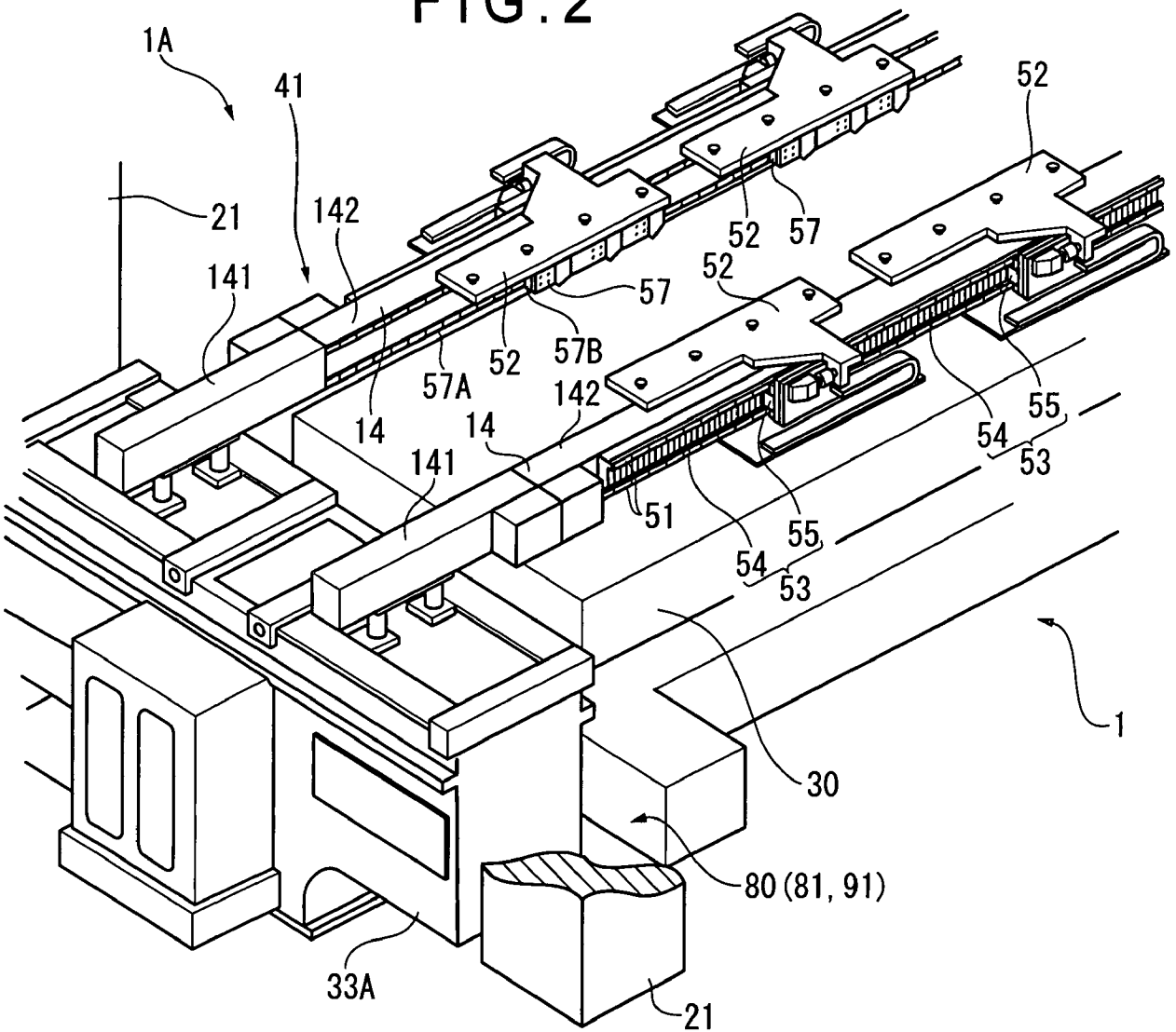
FIG. 2 is a perspective view showing a work carrying device according to the first embodiment of the present invention.

FIG. 1 is a front elevational view showing a transfer press (pressing machine) 1 according to the first embodiment of the present invention. FIG. 2 is a perspective view showing a transfer feeder (work carrying device) 41.

Entire construction of the transfer press 1 as the first embodiment of the present invention will be described below with reference to FIG. 1.

The transfer press 1 includes a press main body 1A, dies 11 each having an upper die 12 and a lower die 13, a moving bolster 30, and the transfer feeder 41. The press main body 1A further includes a bed 23, uprights 21, a crown 20, and a slide 22. A general purpose robot 7 for carrying out the work is provided on the downstream side of the transfer press 1.

The bed 23, which is the base of the transfer press 1, is provided below the floor (FL). A plurality of uprights 21 (the number is four in the present embodiment) are erected on the bed 23, the uprights 21 being opposing to each other respectively in a feed direction (i.e., a direction parallel to a transfer direction of the work 2) and in a clamp direction (i.e., a horizontal direction perpendicular to the feed direction, namely, a direction vertical to the paper surface in FIG. 1). A crown 20 with a slide drive device (not shown) housed therein is supported by the uprights 21. A slide 22 that can be moved upward and downward by the slide drive device is suspended below the crown 20. A plurality of upper dies 12 each corresponding to a press working process are detachably installed on the lower surface of the slide 22 along the feed direction. A moving bolster 30 is provided on the upper surface of the bed 23. A plurality of lower dies 13 respectively paired with the plurality of upper dies 12 are detachably installed on the upper surface of the moving bolster 30, each die 13 opposing to respective upper die 12.

The moving bolster 30 will be described as below.

The moving bolster 30 can be carried out/in relative to the upper surface of the bed 23 in order to change the used dies 11 (the upper dies 12 and the lower dies 13) with the dies 11 to be used next.

A rail (not shown) is provided on the floor and on the bed 23, and the moving bolster 30 is provided with a drive device capable of self-running on the rail. When the moving bolster 30 runs in clamp direction driven by the drive device, the moving bolster 30 is carried out from (or carried into) the transfer press 1, after passing through the space between the pair of the uprights 21 erected in parallel with the work transfer direction.

Incidentally, usually two sets of the moving bolsters 30 are prepared. When performing die changing, the moving bolster 30 with the used dies 11 installed thereon is changed in its entirety with the moving bolster 30 on which the dies 11 to be used next are installed outside the transfer press 1 in advance, so that the dies 11 can be automatically changed quickly according to the work.

The transfer feeder 41 will be described as below.

As shown in FIG. 2, the transfer feeder 41 is provided with a pair of bars 14 arranged on the right and left relative to the work transfer direction, feed carriers 52 movable relative to the bars 14 in the feed direction, feeding linear motors (feed drive mechanisms) 53 for moving the feed carriers 52 in the feed direction, and lift/clamp devices (lift drive mechanisms and clamp drive mechanisms) 80 for moving the feed carriers 52 in a vertical direction (i.e., a direction perpendicular to the feed direction and the clamp direction, namely a lift direction) and the clamp direction.

The pair of the bars 14, which extend in parallel in the feed direction with a given distance therebetween, respectively have fixed bars 141 fixed to the lift/clamp devices 80, and movable bars 142 capable of being detached from the fixed bars 141 when performing die changing.

On the bed 23, two frames 33A are respectively provided between two upstream uprights 21 on both sides in the work transfer direction, and between two downstream uprights 21 on both sides in the work transfer direction (FIG. 2 shows only the frame 33A between two upstream uprights 21). The frames 33A are respectively provided with the lift/clamp devices 80. The pair of the movable bars 142 are respectively installed with a plurality of the feed carriers 52 paired with each other, and a plurality of the feeding linear motors 53 for moving respective feed carriers 52 in the feed direction.

Figure 3:
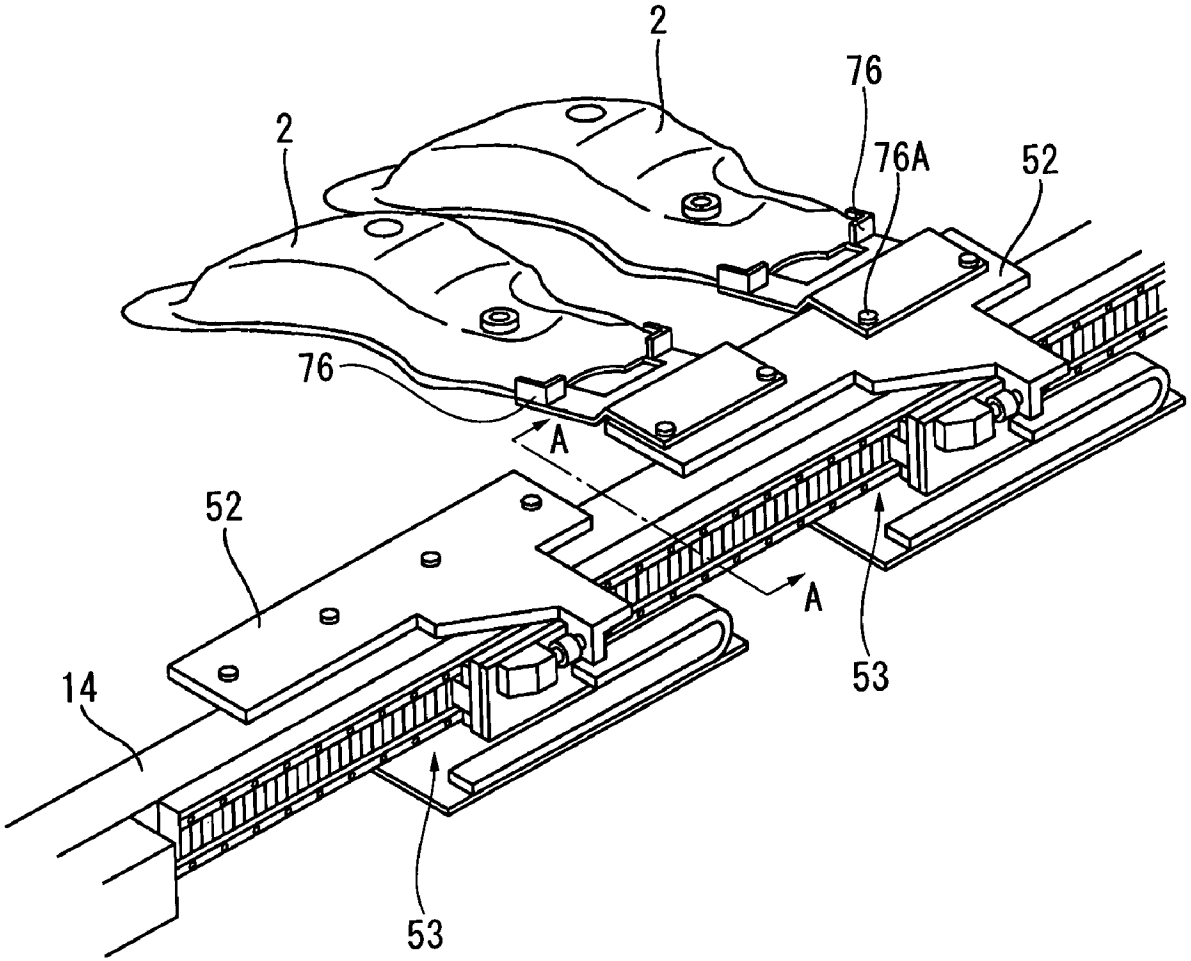
FIG. 3 is a perspective view showing feed carriers according to the first embodiment of the present invention.
Figure 4:
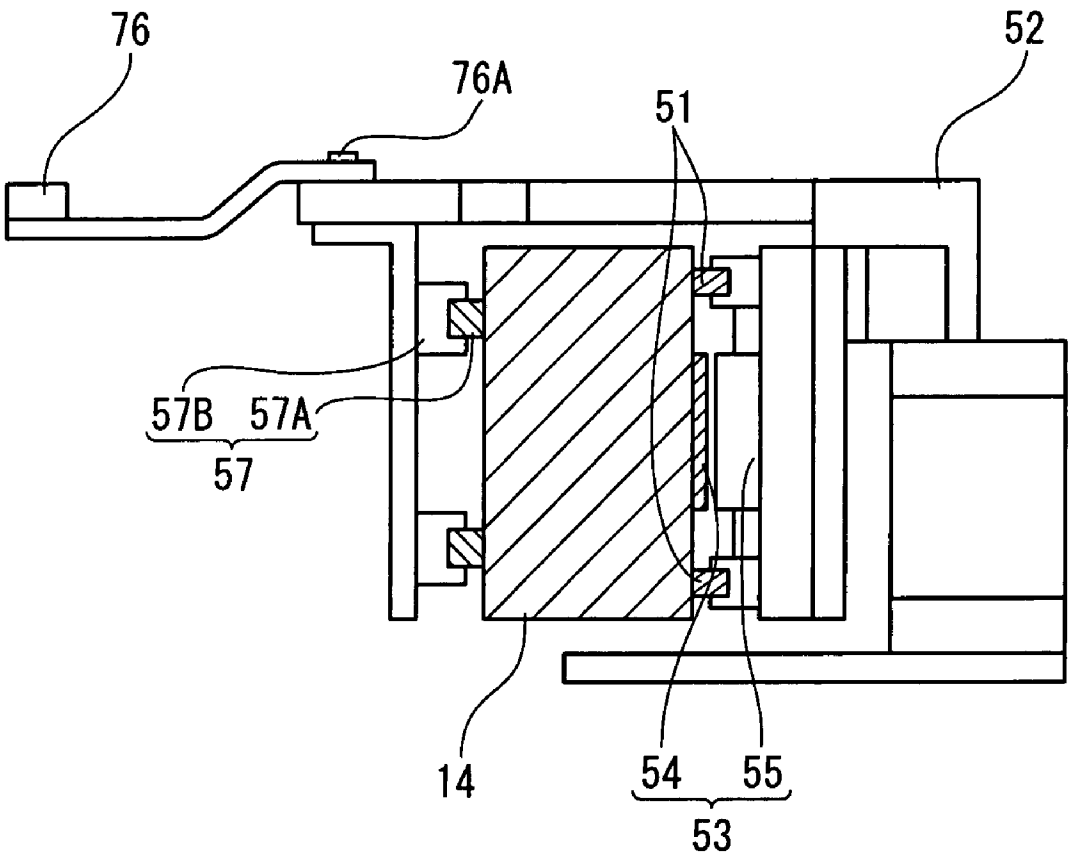
FIG. 4 is a cross section taken along line A-A of FIG. 3.

FIG. 3 is an enlarged perspective view showing the feed carriers 52. FIG. 4 is a cross section taken along line A-A of FIG. 3. As shown in FIGS. 3 and 4, linear guides 57 are respectively provided on the inner surfaces of the pair of the bars 14 (i.e., the surfaces of the bars 14 facing to each other). The linear guide 57 includes a linear guide rail 57A provided on the inner surface of the bar 14 extending in the feed direction and a linear guide holder 57B fixed to the feed carriers 52. Further, the outer surfaces of the bars 14 are also respectively provided with feeding rails 51, 51, which are similar to the linear guide 57. Due to the provision of the linear guide 57 and the feeding rails 51, 51, the feed carriers 52 are held so as to be movable in the feed direction.

The feeding linear motor 53 includes a magnet plate 54 between the feeding rails 51, 51, and a coil plate 55 opposing to the magnet plate 54. The magnet plate 54 is a fixed part provided on the outer surface of the bar 14 (i.e., the surface of the bar opposite to the inner surface) along the feed direction, and the coil plate 55 is a movable part fixed to the feed carrier 52 via a connecting member. When a current flows so that a shifting magnetic field is generated to the coil plate 55, the coil plate 55 will move due to the attraction and repulsion force against the magnet plate 54. The feed carrier 52 is moved along with the coil plate 55, thus the feed carrier 52 is forced to perform a feed operation. The feeding linear motor 53 is provided for each of the feed carriers 52, so that the plurality of feed carriers 52 can be individually moved in the feed direction, and the motion of the respective feed carriers 52 can be individually controlled.

Though herein the linear guide 57 is provided on the inner surface of the bar 14, and the feeding linear motor 53 is provided on the outer surface of the bar 14, the arrangement is not necessary to be limited thereto, but the linear guide 57 and the feeding linear motor 53 can be provided on the inner surface, outer surface, upper surface and lower surface of the bar 14. Further, the linear guide 57 and the feeding linear motor 53 can also be provided on the same surface of the bar 14.

In the case of a conventional feed device, though the bar is provided with a plurality of work holders in the feed direction, however, since the work holders are fixed to the bar at predetermined intervals respectively, the work holders can only perform the feed motion common to all working processes. Thus, not only the cost is increased due to low freedom in die designing and large variety of dies, but also productivity is difficult to be improved because the press operation can not be quickly performed corresponding to respective dies. Further, since the pitches between the dies (the work feed stroke) have to be set according to the die corresponding to the largest work, the entire pressing machine becomes unnecessary large, so that the plant cost becomes high.

In contrast, in the first embodiment, the bar 14 is provided with a plurality of feed carriers 52 in the feed direction, and the feed carriers 52 can individually perform optimal motion under the control of a controller (not shown). With such an arrangement, since the work transfer distance can be freely set for respective feed carrier 52, and the optimal work feed strokes for respective works 2 can be set according to the size of dies 11 of respective working processes, the freedom in die designing becomes high, so that it becomes possible to design the optimal dies for respective working processes. Further, since work feed strokes for respective feed carriers 52 and feed speeds corresponding to respective feed positions can be freely set, the optimal feed motions can be obtained for the dies 11 of respective working processes, the transfer press 1 can be driven at high speed, feed miss can be reduced, and productive efficiency can be improved.

Further, since the feeding linear motor 53, which has fewer components including no rotating component, is used as a feed drive mechanism for the feed carrier 52, the feed drive mechanism can be made light in weight and small in size, so that the manufacturing cost for the feed drive mechanism can be reduced. Further, since the feeding linear motor 53 is small in size and light in weight, occurrence of chattering of the bar 14 can be suppressed when performing start operation, stop operation and inching operation, the transfer feeder 41 in its entirety can operate at high speed with high positional accuracy, so that the transfer press 1 can be driven at high speed. Further, since chattering of the bar 14 can be suppressed, noise can be suppressed during driving, so that not only the working environment can be improved, but also the durability in each part of the transfer feeder 41 can be improved. As a result, not only the transfer press 1 has excellent maintainability, but also the service life of the transfer press 1 is elongated.

A finger (work holder) 76 for holding the work 2 is detachably installed to the feed carrier 52 via a mounting bracket 76A, the finger protruding toward the opposite bar 14.

Figure 5:
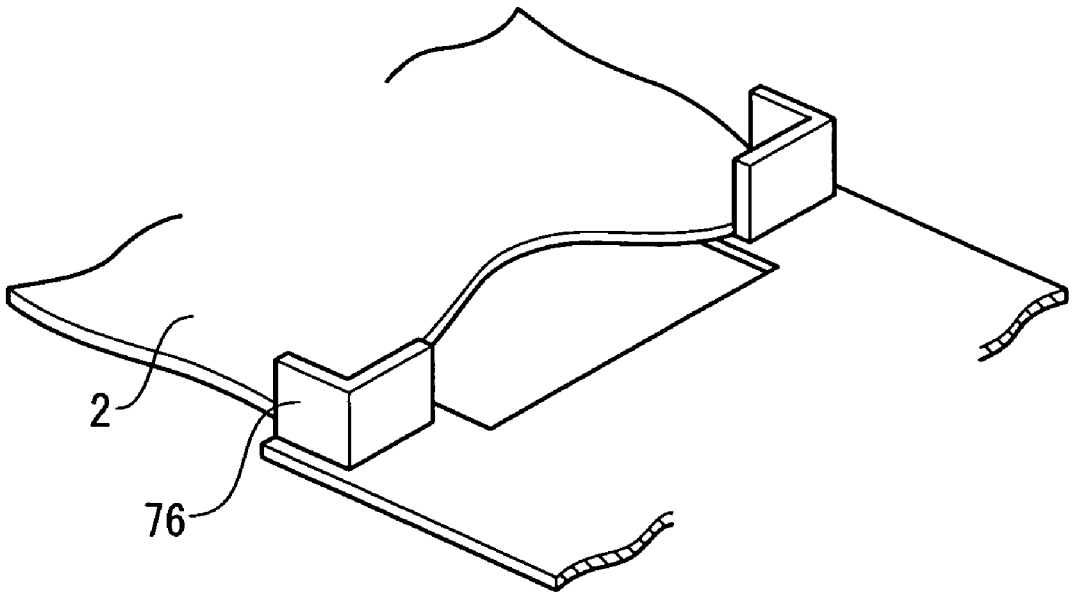
FIG. 5 is a perspective view showing a work holder according to the first embodiment of the present invention.

FIG. 5 is a perspective view showing the finger 76. As shown in FIG. 5, in the first embodiment, the feed carrier 52 is provided with plural fingers 76 (in the present embodiment, two fingers are provided), so that two works 2 (see FIG. 3) can be held by the two fingers 76 and the other two fingers 76 (not shown) installed on the feed carrier 52 on the opposing side. Since the feed carrier 52 is provided with plural (the number corresponding to the number of the working processes) fingers 76 to hold the plural works 2, the number of the feeding linear motor 53 can be reduced, so that not only the construction of the transfer feeder 41 can be simplified, but also the manufacturing cost can be reduced.

Figure 6:
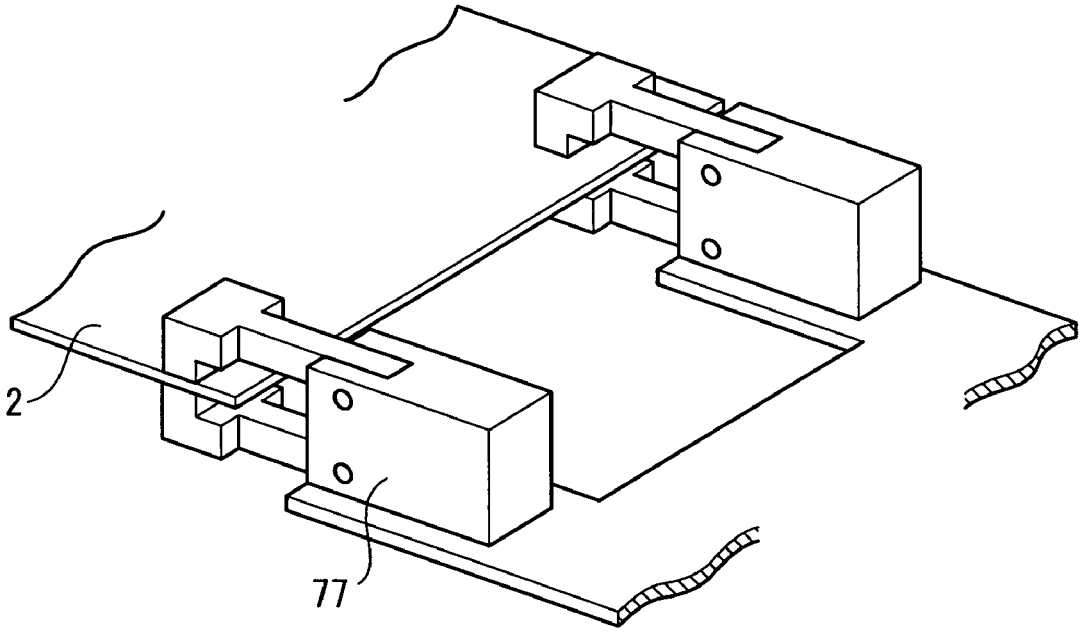
FIG. 6 is an illustration showing a modification of the work holder of the present invention.
Figure 7:
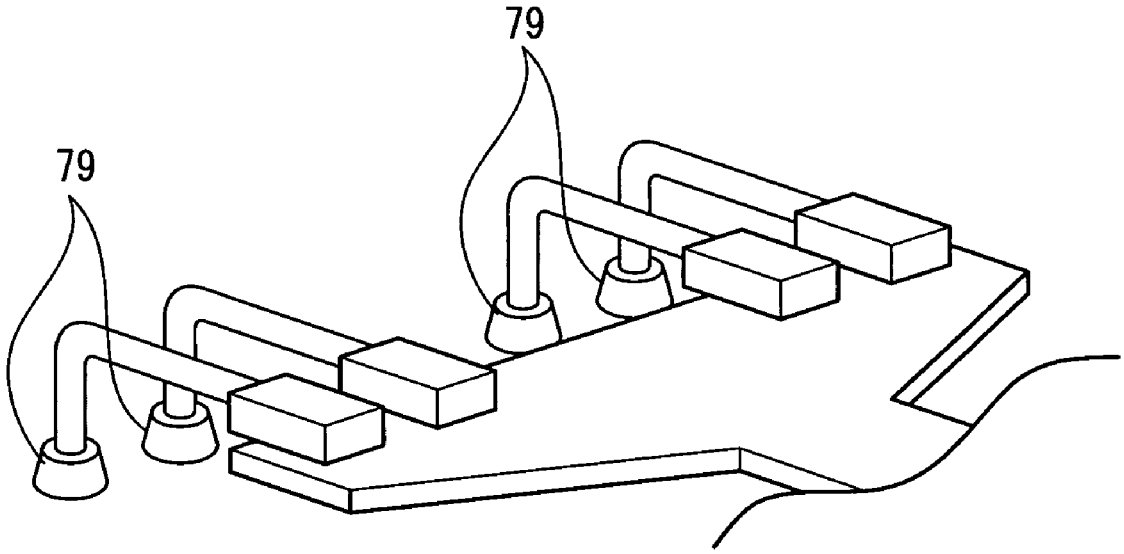
FIG. 7 is an illustration showing another modification of the work holder of the present invention.

Incidentally, in the first embodiment, though the finger 76, which positions and mounts the work 2, is used as the work holder for holding the work 2, the work holder is not limited thereto, and, for example, a gripper 77 as shown in FIG. 6 for gripping the work 2 also can be used as the work holder. Alternatively, as shown in FIG. 7, the work holder also can be a vacuum cup 79 which sucks and holds the work 2. Further, though the number of the finger 76 provided to the feed carrier 52 is the number necessary for holding the work 2 for performing two working processes in the first embodiment, the number of the fingers 76 can be the number necessary for performing one working process, three working processes, or more than three working processes. Note that the number of the fingers 76 for each work 2 needs not to be limited to two, but can be one, three, or more than three.

Further, though the description is based on the configuration in which the magnet plate of the linear motor is a fixed part and the coil plate is a movable part, the configuration also can be the one in which the magnet plate is a movable part and the coil plate is a fixed part.

The lift/clamp device 80 which moves the bar 14 in the vertical direction (i.e., the lift direction) and the clamp direction will be described as below.

Figure 8:
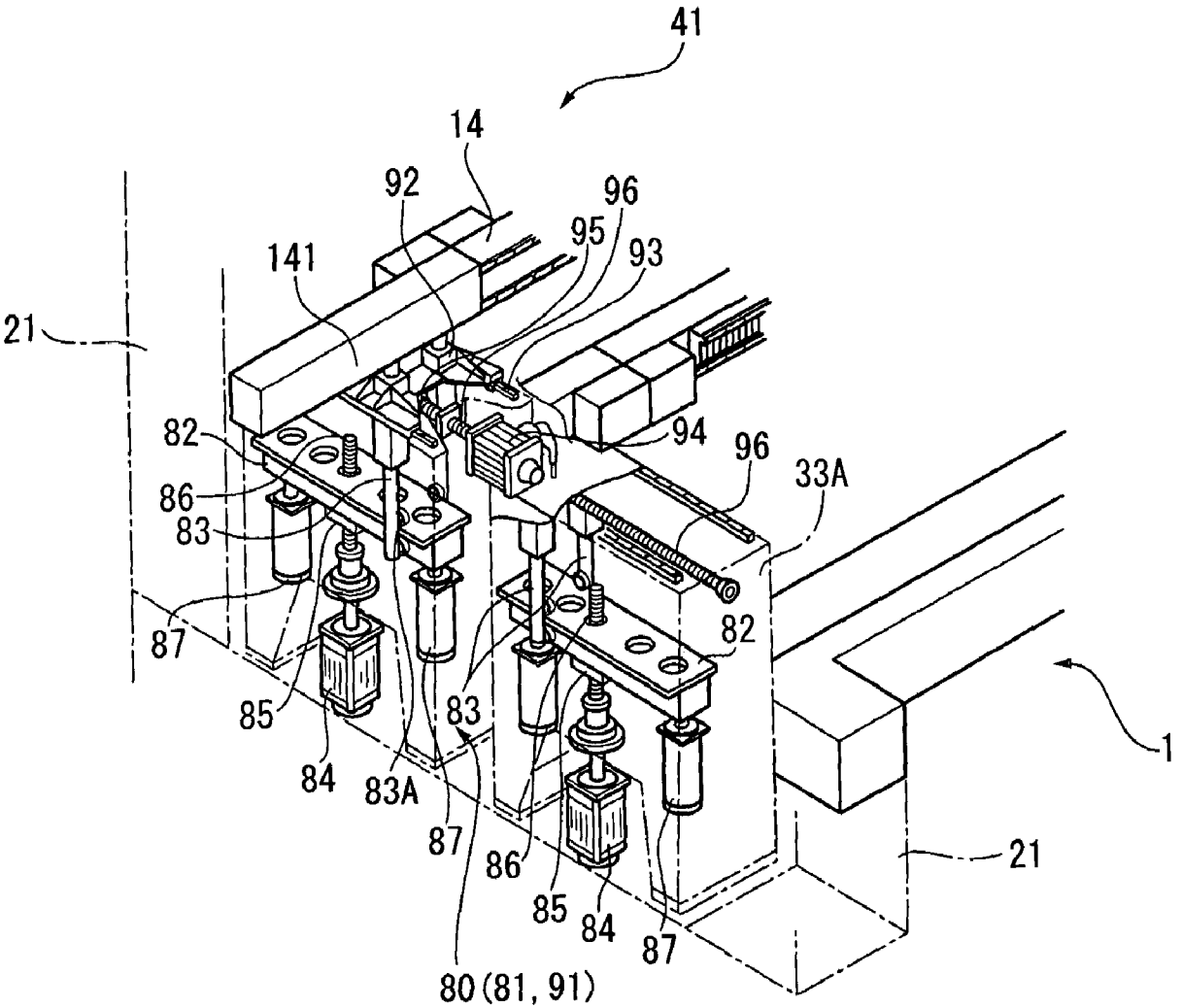
FIG. 8 is a perspective view showing a lift drive mechanism and a clamp drive mechanism according to the first embodiment of the present invention.

FIG. 8 is a perspective view showing the lift/clamp device 80. As shown in FIG. 8, the lift/clamp device 80, which includes a lift device (a lift drive mechanism) 81 and a clamp device (a clamp drive mechanism) 91, is provided in the frame 33A. There are two lift/clamp devices 80 respectively connected to the fixed bars 141 of respective bars 14.

The upper part of the lift device 81 is installed to the bar 14, and the lower part of the lift device 81 is provided with two lift bars 83, 83, each having a cam follower 83A that can move in the clamp direction, and a lift carrier 82 that rises and descends the bar 14 in the vertical direction (i.e., the lift direction) through the lift bar 83 and the cam follower 83A. Further, a nut 85 is fixed to the lift carrier 82. Further, a lift drive motor 84 for rotating a screw 86, so that the lift carrier 82 is lift-driven together with the nut 85 engaged with the screw 86. Further, in order to smooth the rising/descending motion of the lift carrier 82 and to balance the weight of the bar 14 and the lift carrier 82, lift balancers 87, 87 are respectively installed to the lift carrier 82 at two end portions thereof in the clamp direction.

The clamp device 91 is provided with a clamp carrier 92 arranged between the two lift bars 83, 83, and a linear guide 93 for guiding the clamp carrier 92 to move in the clamp direction, as well as a clamp drive motor 94 for driving the clamp carrier 92 in the clamp direction, a screw 96, and a nut 95.

The two lift bars 83, 83 penetrate through the clamp carrier 92 such that the clamp carrier 92 can move in the vertical direction. The linear guide 93 includes a linear guide rail provided on the upper face of the frame 33A and extending in the clamp direction, and a linear guide holder fixed to the lower face of the clamp carrier 92. With such an arrangement, the clamp carrier 92 not only can be moved in the vertical direction relative to the lift bar 83, but also can be moved in the clamp direction due to the provision of the linear guide 93.

The screw 96 is connected to the clamp drive motor 94, the screw 96 extending in the clamp direction and penetrating the clamp carrier 92. The nut 95 is fixed to the clamp carrier 92, the nut 95 being engaged with the screw 96. When the clamp drive motor 94 is driven, the screw 96 is rotated, so that the clamp carrier 92, to which the nut 95 is fixed, moves in the clamp direction. Thus the cam follower 83A rolls and moves along the lift carrier 82, and the lift bar 83 moves in the clamp direction. Thus the bar 14 moves in the clamp direction.

Incidentally, the pair of the bars 14 respectively perform motions in mutually opposite directions. Namely, the pair of the bars 14 move toward or away from each other.

The operation of the transfer feeder 41 of the present invention shown in FIGS. 1 and 2 will be explained as follows by exemplifying a case where a work 2 is being carried into the transfer press 1.

Figure 9:
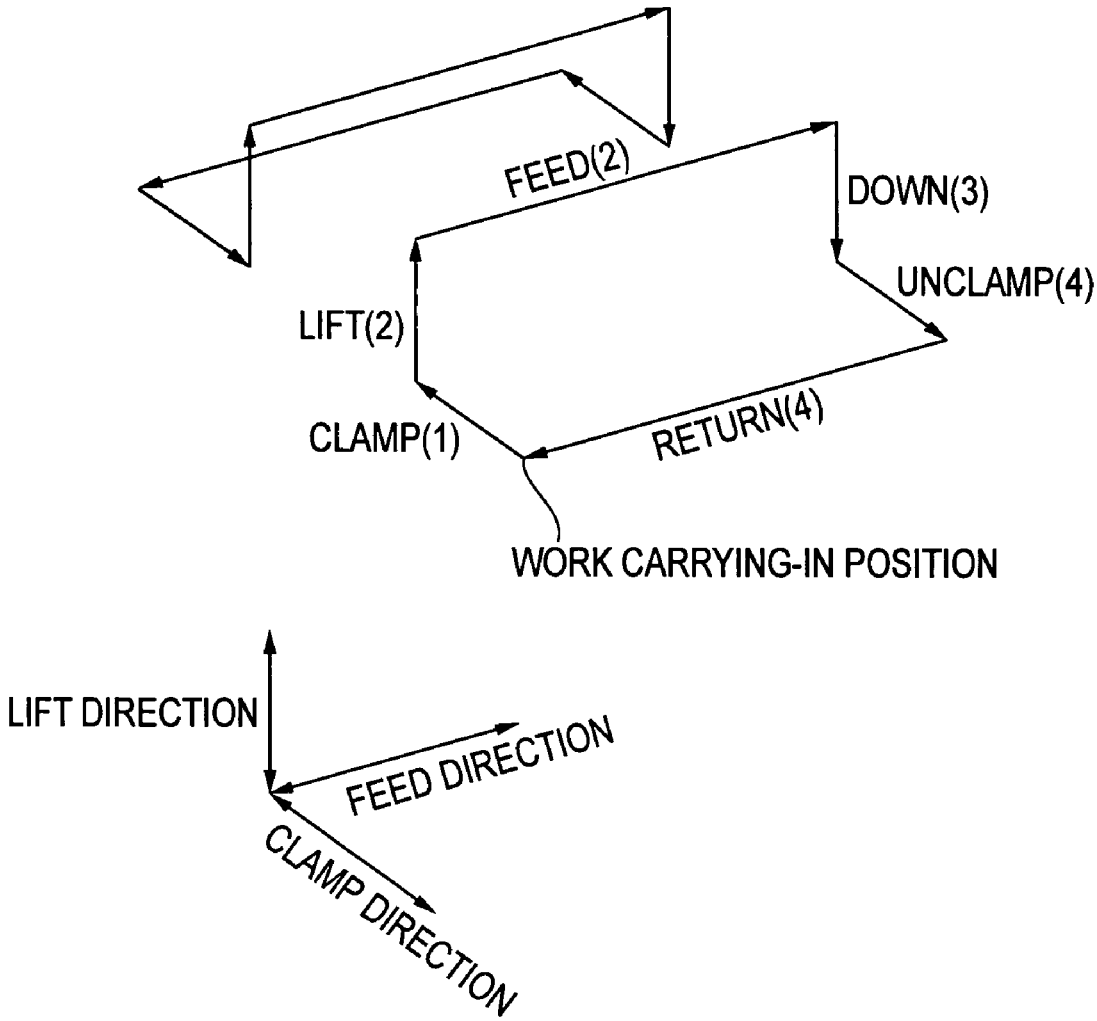
FIG. 9 is an illustration explaining the motion of the work holder according to the first embodiment of the present invention.

FIG. 9 illustrates the motion of the finger 76 in the first embodiment.

(1) First, the work 2 is carried and placed onto a work receiving table (not shown) arranged in a work carrying-in position of the bar 14 (a position at an upstream end of the bar 14) by a transfer device such as a general purpose robot (not shown). At this time, the bar 14 is in down position (at downward end of the bar 14, namely at downward end of a lift stroke) as well as in unclamp position (at outward end of the bar, namely at outward end of a clamp stroke). When the bars 14 are moved toward each other driven by respective clamp devices 91, the feed carrier 52 is moved toward clamp position (at inward end of the bar, namely at inward end of a clamp stroke), so that the bar 14 on the work receiving table is mounted to the finger 76 installed on the feed carrier 52.

(2) Next, in the state where the work 2 is mounted on the finger 76, when the bar 14 is lifted up by the lift device 81, the feed carrier 52 follows the motion of the bar 14 to perform a lift motion from the down position to a lift position (at upward end of the lift stroke). Further, when the feed carrier 52 in the uppermost stream is individually driven by the feeding linear motor 53, the feed carrier 52 performs a feed motion to the position of a first working process (a working process performed on left end of slide 22 in FIG. 1) of press-molding work. Consequently, the work 2 mounted on the finger 76 is transferred (carried forward) to the first working process from outside of the transfer press 1. Note that the plurality of feed carriers 52 are not limited to be subjected to controlled drive individually, but can be subjected to controlled drive simultaneously so that all feed carriers 52 perform the same operation.

(3) Upon the work 2 reaches the position of the first working process of press-molding work, the lift device 81 is driven so as to move the bar 14 to the down position in order to set the work 2 onto the lower die 13 of the first working process of press-molding work.

(4) After the work 2 is set onto the lower die 13, when the bar 14 is driven by the clamp device 91 so as to move away from the other bar 14, the feed carrier 52 follows the motion of the bar 14 to perform an unclamp motion from the clamp position to the unclamp position, so that the finger 76 is retreated from the work 2. Further, when the feed carrier 52 is driven by the feeding linear motor 53, the feed carrier 52 is returned (carried backward) from the first working process toward the work receiving table until reaching the work receiving table again.

Incidentally, after the finger 76 is moved to the unclamp position (namely the bar moves backward) to retreat from the area of interfering with the die 11, the slide 22 is descended to descend the upper die 12 installed on the lower surface of the slide 22, so that a predetermined press-molding work of the first working process is performed by pressuring and holding the work 2 between the upper die 12 and the lower die 13.

Next, the details of carrying the work 2 into the position of a next working process and performing press-molding work of the next working process are the same as the details of carrying the work 2 into the position of the first working process from the carrying-in position by the transfer feeder 41 and performing press-molding work of the first working process to the work 2. That is, the details of carrying the work 2 from the position of the first working process to the position of a second working process of press-molding work by the transfer feeder 41 and the details of performing press-molding work of the second working process to the work 2 are the same as described above. Further, the details of carrying the work 2 from the position of the second working process to the position of a third working process by the transfer feeder 41 and the details of performing press-molding work of the third working process to the work 2 are the same as described above.

After the press-molding work of a lowermost stream working process (a fifth working process in the present embodiment) has been performed to the work 2 in the position of the lowermost stream working process, the work 2 is transferred from the position of the lowermost stream working process to a work receiving table located in a work carrying-out position of the bar 14 (a position at the downstream end of the bar 14) by the transfer feeder 41. The press-processed work 2 transferred to the work receiving table located in a work carrying-out position is then carried outside the pressing machine by the general purpose robot 7.

As described above, the transfer feeder 41 of the present invention performs a three-dimensional operation. Specifically, the feed carrier 52 repeatedly performs a feed/return motion relative to the bar 14 in the work transfer direction, the bar 14 repeatedly performs a rising/descending motion (i.e., a lift/down motion), and the bar 14 also repeatedly performs a clamp/unclamp motion in a horizontal direction perpendicular to the work transfer direction. By appropriately reciprocating the work holder (the finger 76) held on the feed carrier 52 in the feed direction, the lift direction and the clamp direction, the work 2 is sequentially transferred from the lower die 13 on an upstream side (the left side in FIG. 1) to the lower die 13 on a downstream side (the right side in FIG. 1).

Figure 10:
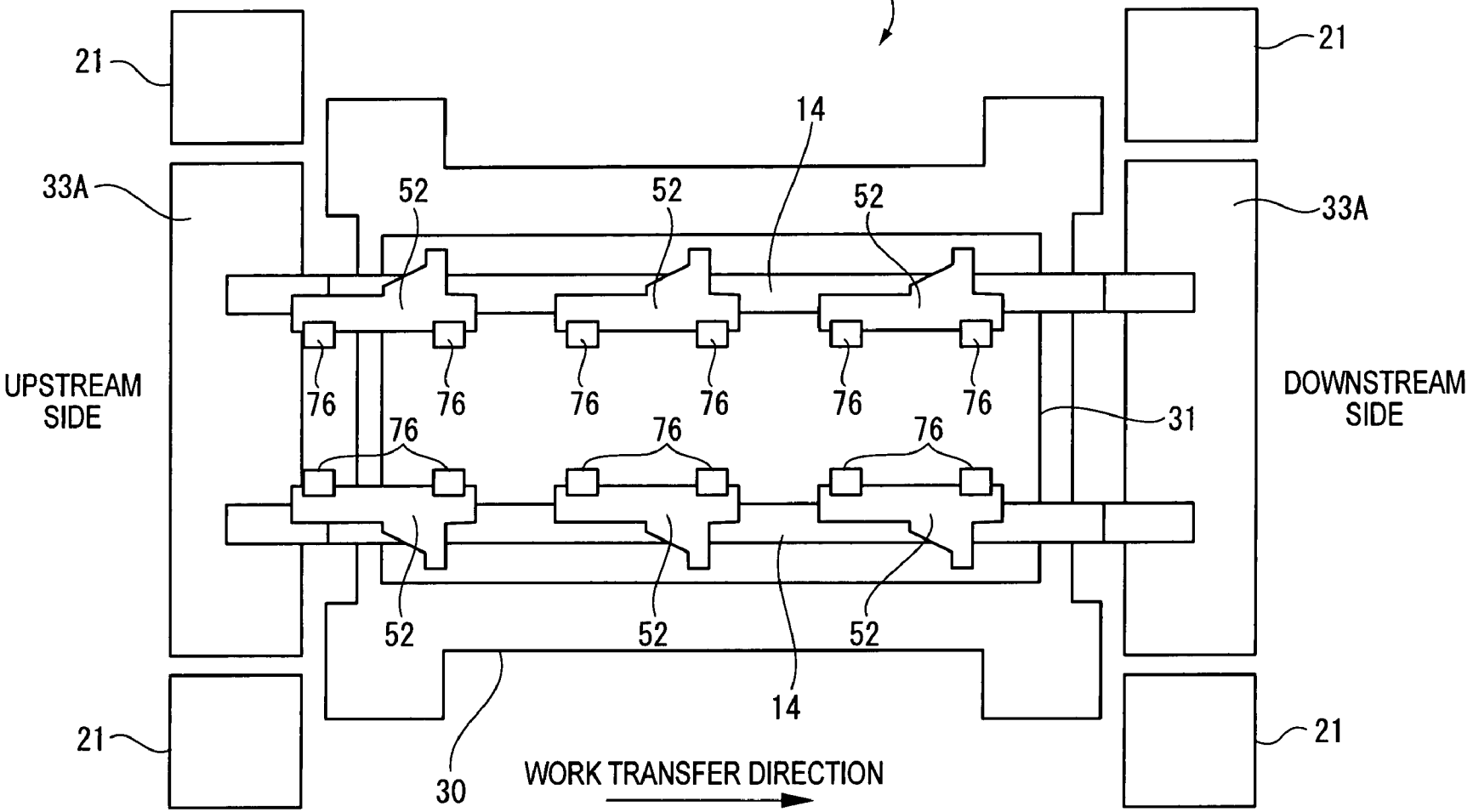
FIG. 10 is a top view showing the work carrying device according to the first embodiment of the present invention.

FIG. 10 is a top view of the transfer press 1 illustrating the positions of the feed carriers 52 at the time when a work 2 is carried from the work receiving table (not shown) in the work carrying-in position to the uppermost stream working process (the first working process in the present embodiment) of the transfer press 1. In FIG. 10, the fingers 76 in the uppermost stream are positioned outside a bolster 31 of the moving bolster 30, namely, are positioned at a location that is projected from the bolster 31 and the moving bolster 30, in the plan view of the transfer press 1 (namely when viewed from a direction vertical to the paper surface of FIG. 10). At this time, the fingers 76 in the uppermost stream are positioned on the upstream side of the downstream part of the two uprights 21 on the upstream side. This position is the position for performing an idle process for carrying-in work. On the other hand, at this time, the fingers 76 in the lowermost stream are positioned in the lowermost stream working process (the fifth working process in the present embodiment). In this state, when the works 2 are mounted on respective fingers 76, the material (the work 2) supplied from the outside of the transfer press 1 is mounted on the fingers 76 in the uppermost stream, and the works 2 finished with respective stages of working process are mounted on other fingers 76. In this state, the respective feed carriers 52 are moved in the feed direction, so that the works 2 are respectively transferred to the next working process.

Figure 11:
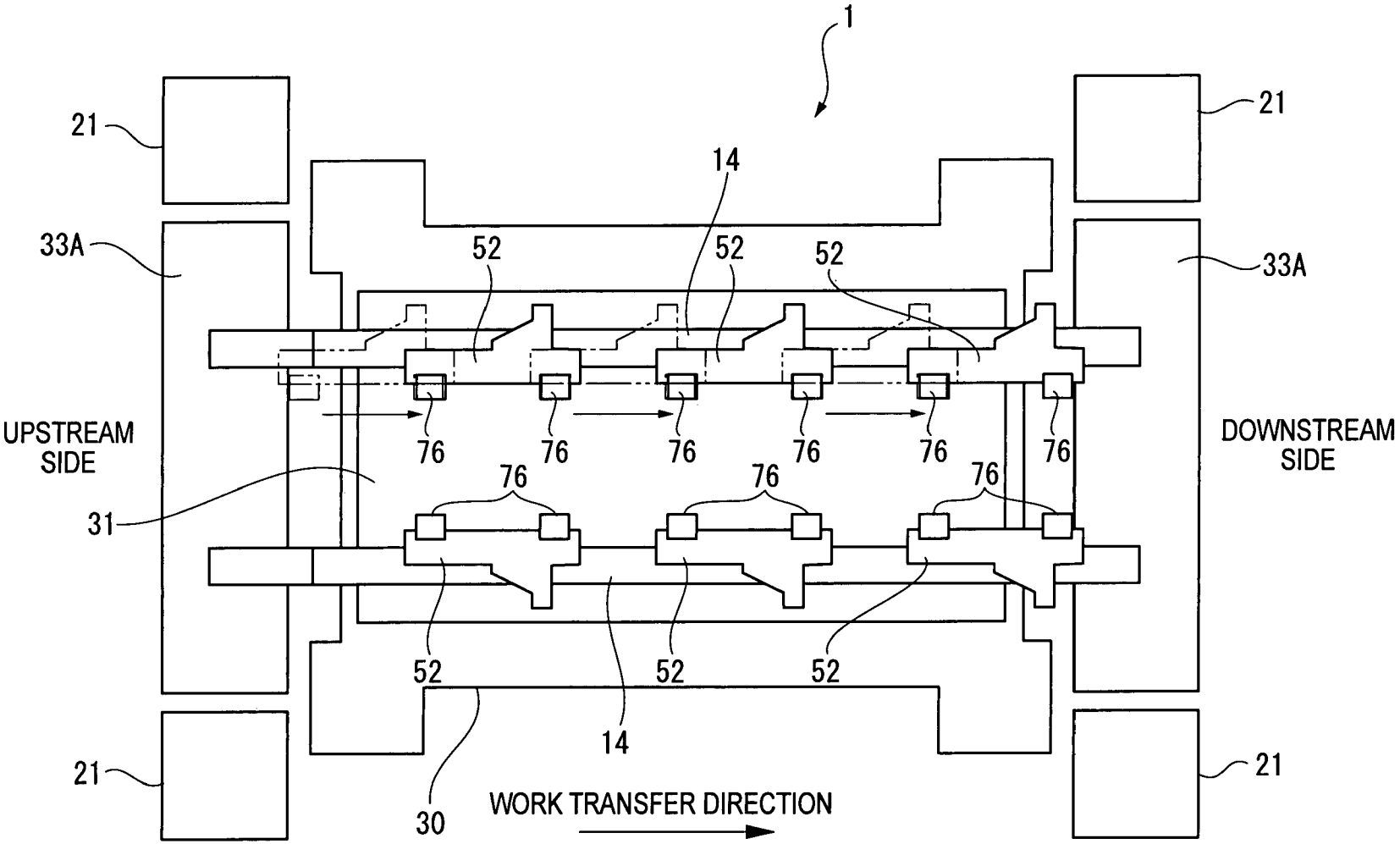
FIG. 11 is a top view showing the work carrying device according to the first embodiment of the present invention.

FIG. 11 is a top view of the transfer press 1 illustrating the positions of the feed carriers 52 at the time when a work 2 is carried out from the lowermost stream working process of the transfer press 1 toward the work receiving table (not shown) located in the work carrying-out position. In FIG. 11, the respective feed carriers 52 are in the state of having finished the movement for transferring respective works 2 from the positions of the previous stage of working process (the positions shown by alternate long and two short dashes lines in FIG. 11) to the positions of the next stage of working process. In FIG. 11, the fingers 76 in the uppermost stream are positioned in the uppermost stream working process. On the other hand, the fingers 76 in the lowermost stream are positioned outside the bolster 31, namely, are positioned at location that is projected from the bolster 31 and the moving bolster 30. At this time, the finger 76 in the lowermost stream is positioned on the downstream side of the upstream part of the two uprights 21 on the downstream side. This position is the position for performing an idle process for carrying out a work. When the respective fingers 76 transfer the respective works 2 finished with respective stages of working process to the next stage of working process, the fingers 76 which mount the work 2 finished with the lowermost stream working process transfer the work 2 to the outside of the transfer press 1, so that the work 2 is carried outside the transfer press 1 so as to be transferred to the general purpose robot 7.

Since the installation space near a conventional feed box is narrow, a general purpose robot can not be set adjacent to pressing machine on its downstream side, therefore a discharge conveyor has to be employed. Thus not only a wide space for installing entire press device is necessary, but also facility cost becomes high. Further, in the case where the feed box is projected from the lateral surface of the press main body, a stack section for material has to be provided on the upstream side of the feed box, therefore not only a wide space for installing entire press device is necessary, but also major restriction is caused on the installation space for the material charging device, as a result an unreasonable structure has to be adopted.

Different from the conventional drive mechanism in which the bar 14 itself performs all three-dimensional motions of the feed/return motion, the rising/descending motion (i.e., the lift/down motion), and the clamp/unclamp motion, in the first embodiment, the motion of the finger 76 in the feed direction (which requires a long stroke) is performed by the feed drive mechanism (the feeding linear motor 53) that is directly provided on the bar 14 to move the feed carrier 52, to which the finger 76 is installed, in the feed direction along the longitudinal direction of the bar 14.

With such an arrangement, the feed drive mechanism, which requires a long stroke, can be compactly installed in the press main body 1A. Thus the conventional feed box projected from the lateral surface of the press main body is eliminated, and the space can be used for setting the general purpose robot 7, so that a discharge conveyor becomes unnecessary. Thus not only a wide installation space for the pressing machine is unnecessary, but also facility cost becomes low.

Further, since the general purpose robot and the stack section for material can be installed adjacent to the pressing machine, not only a spatially wide factory layout can be provided, but also cost can be reduced. Further, since restriction on the space for installing the material charging device becomes less, the structure can be optimized.

Further, since the conventional feed device has to move a long and heavy bar at high speed, high output and high rigidity are required for the drive device thereof, therefore a large-sized expensive feed device has to be used. However, according to the first embodiment, since the feeding linear motor 53 is arranged on the bar 14, the object to be driven is small in size and light in weight, therefore only a low drive output is needed. Thus, not only the transfer feeder 41 can be downsized so as to reduce the manufacturing cost, but also energy can be saved. Further, the transfer feeder 41 in its entirety can operate at high speed with high positional accuracy, so that productivity can be improved.

However, when performing die changing, since respective fingers 76 are also need to be changed corresponding to the die, the fingers 76, 76 need to be mounted on the moving bolster 30 together with the bars 14 so as to be moved out from the work transfer area. However, since the bar 14 is supported by the lift/clamp devices 80 provided in the frames 33A, the bar 14 is prevented from being carried out.

Figure 12:
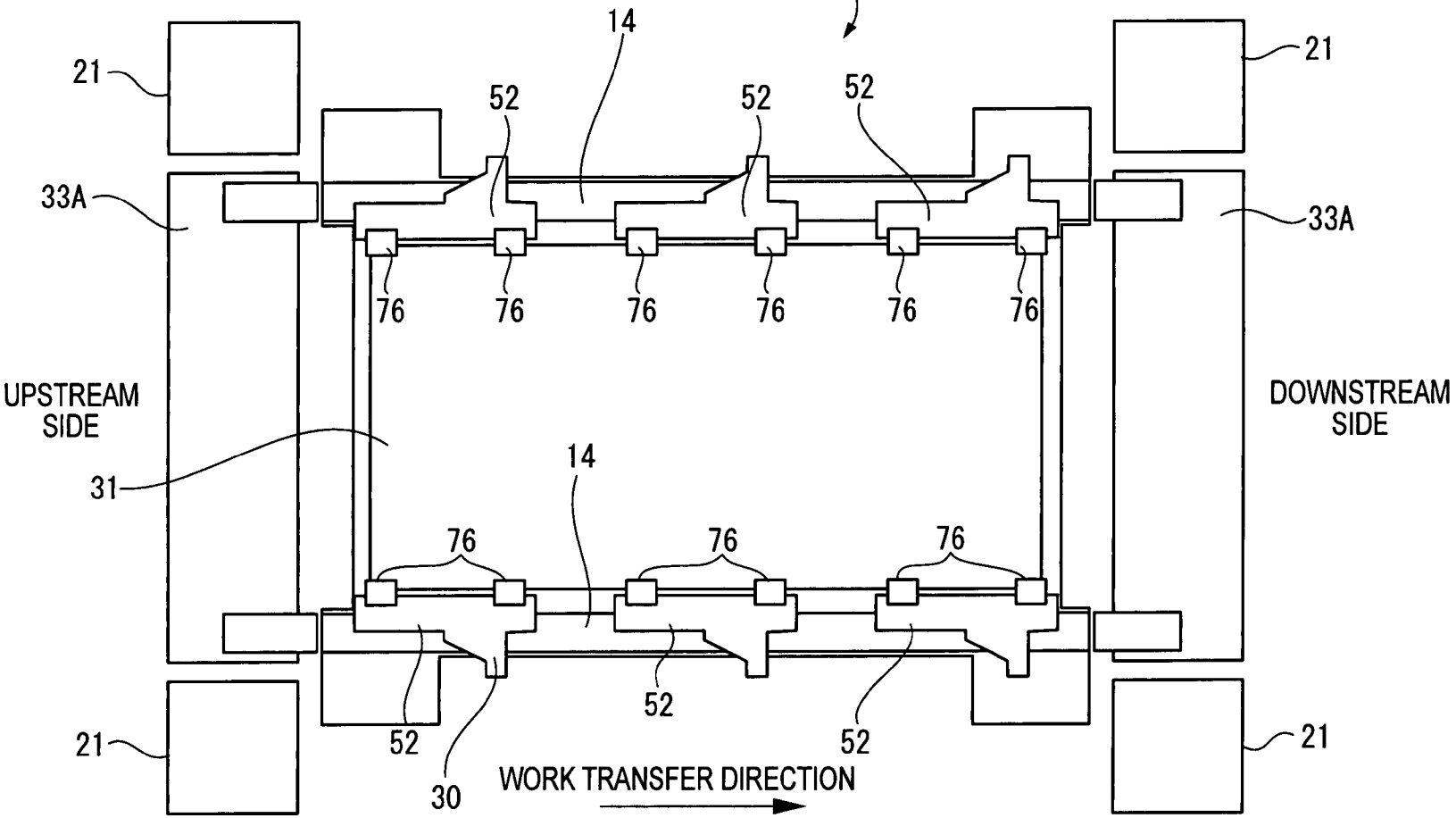
FIG. 12 is a top view showing the work carrying device according to the first embodiment of the present invention.

To solve this problem, as shown in FIG. 12, the movable bar 142 of the bar 14 is split and removed from the fixed bar 141. The moving bolster 30 is provided with a bar receiving table (not shown) equipped with an elevating/lowering device on the outside of the bar 14 to support the split bar 14 (the movable bar 142), as shown in FIG. 12.

Incidentally, the bar receiving table can alternatively be provided with a drive section for moving the movable bar 142 in the clamp direction, so that when performing die changing outside the press main body, since the bar interval can be widened while exchanging the die mounted on the moving bolster 30, die changing operation can be further facilitated.

Incidentally, when performing die changing, in the case where the feed carrier 52 is in a position of interfering with the uprights 21 on the upstream side or in a position of interfering with the uprights 21 on the downstream side, the feed carrier 52 can individually be moved to an optimal position (where the ends of the finger 76 and the feed carrier 52 are positioned within the space between the uprights 21 on the upstream side and the uprights 21 on the downstream side, as shown in FIG. 12) in advance. Thus the feed carrier 52 and the finger 76 installed on the feed carrier 52 can be retreated from the area of interfering with upright 21 so as to be quickly moved outside the pressing machine. Thus the time for performing ADC (automatic die changing) operation can be shortened and therefore machine operation rate can be enhanced.

Second Embodiment

A second embodiment of the present invention will be described below. Note that like components are denoted by like numerals as of the first embodiment and the explanation thereof will be omitted. The second embodiment differs from the first embodiment only in the point that, different from the transfer feeder 41 of the first embodiment, a transfer feeder 41A of the second embodiment moves a plurality of feed carriers 52 connected to each other by a feeding linear motor 53A horizontally installed on the bar 14.

Figure 13:
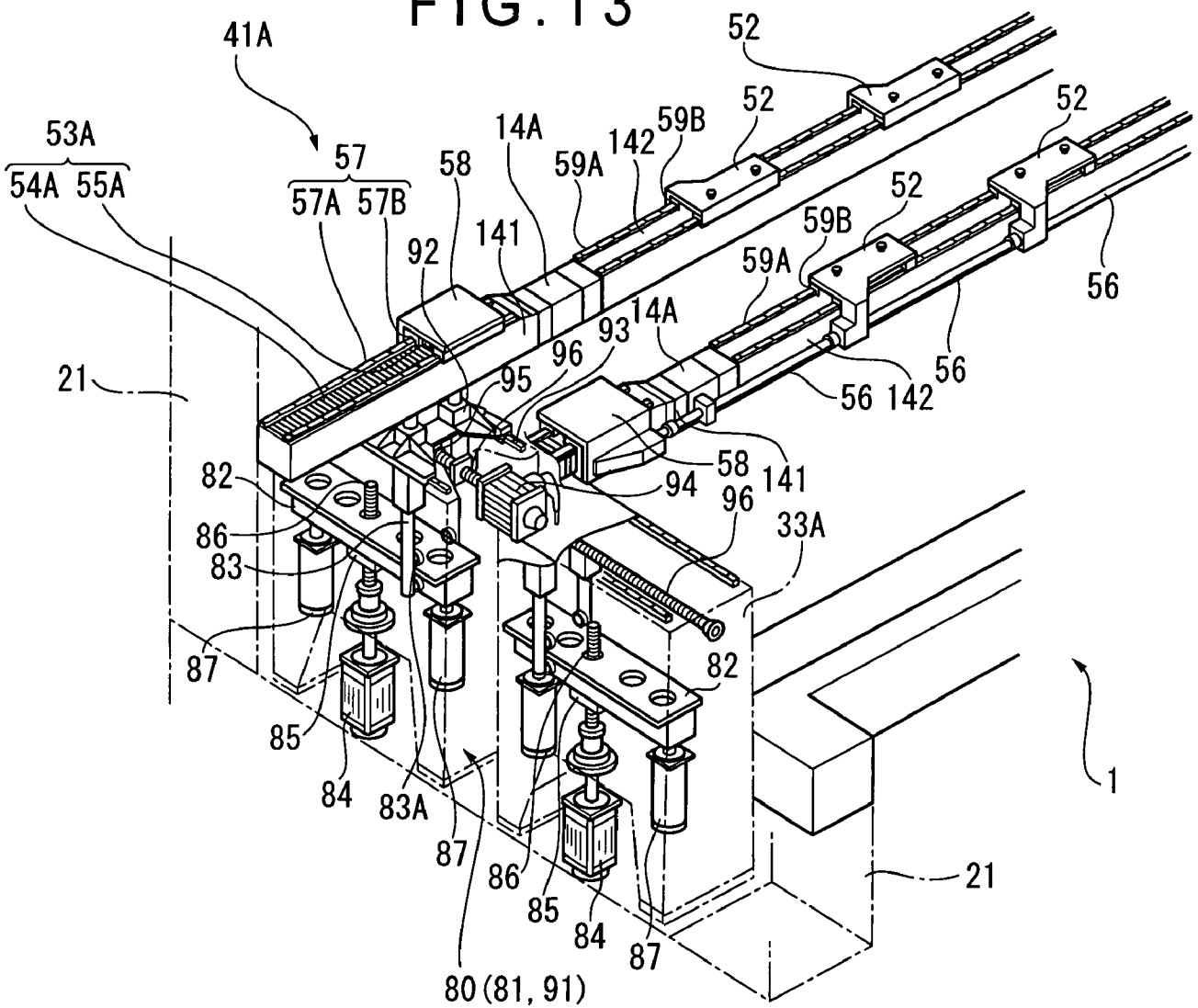
FIG. 13 is a perspective view showing a work carrying device according to a second embodiment of the present invention.

FIG. 13 is a perspective view showing the transfer feeder 41A according to the second embodiment of the present invention. As shown in FIG. 13, in the second embodiment, the fixed bar 141 at one end of the bar 14 is provided with a moving member 58, which is movably guided in the feed direction by a linear guide 57 provided between the moving member 58 and the upper surface of the bar 14. The moving member 58, the linear guide 57, and the feeding linear motor 53A form the feed drive mechanism of the present invention.

Since a pair of the bars 14, each having a feed drive mechanism, are provided, there are provided two feed drive mechanisms. Herein the linear guide 57 includes linear guide rails 57A and a linear guide holder 57B. The linear guide rails 57A are provided on the fixed bar 141 at the upstream end of the bar 14 and extend in parallel in the longitudinal direction (i.e., the feed direction) of the bar 14. The linear guide holder 57B is attached on the lower face of the moving member 58 for moving on the linear guide rail 57A.

The feeding linear motor 53A includes a magnet plate 54A and a coil plate 55A. The magnet plate 54A is provided on the fixed bar 141 and extends in parallel with the linear guide 57. The coil plate 55A is provided on the lower face of the moving member 58.

A connectors 56 for connecting the plurality of feed carriers 52 are provided to the moving member 58 on the face thereof corresponding to the outer surface of the bar 14. The connectors 56 are provided between the moving member 58 and the feed carrier 52 in the uppermost stream, and between the feed carriers 52 adjacent to each other. The plurality of feed carriers 52, which are connected with each other by the connectors 56, are connected to the moving member 58. The mutual intervals between the respective feed carriers 52 are adjusted to a predetermined work transfer pitch by the connectors 56. Each feed carrier 52 is movably guided in the feed direction by linear guide rails 59A, which are provided on the bar 14 along the longitudinal direction of the bar 14, and a linear guide holder 59B attached on the lower face of the feed carrier 52 for moving on the linear guide rails 59A.

The present embodiment is similar to the first embodiment regarding the other portions than the above mentioned feed drive mechanism, and the description in this regard is omitted.

According to the second embodiment, since the adjacent feed carriers 52 are connected with each other by the connectors 56 and connected to the moving member 58, when the moving member 58 is moved by the feeding linear motor 53A in the feed direction, the plurality of feed carriers 52 move together while retaining the predetermined mutual intervals between respective feed carriers 52.

Incidentally, when performing die changing, the bar 14 is split into two parts of the movable bar 142 and the fixed bar 141. Thus the bar 14 is provided with a connecting device in the split parts thereof. The connector 56 is also provided with a connecting device near the connecting device of the bar 14, so that when performing die changing, the connector 56 is also split into a movable part and a fixed part, similar to the bar 14.

In the transfer feeder 41A according to the second embodiment, though a plurality of the feed carriers 52 are provided on the bar 14 in the feed direction, since the adjacent feed carriers 52 are connected with each other by respective connectors 56, only one feeding linear motor 53A is necessary for each of the bars 14.

Thus, since the feed drive mechanism can be made small in size and light in weight by employing a simple structure with small number of component, not only energy can be saved due to low feed drive output, but also manufacturing cost can be reduced.

Third Embodiment

A third embodiment of the present invention will be described below. Note that like components are denoted by like numerals as of the first and second embodiments, and the explanation thereof will be omitted. The third embodiment differs from the first embodiment in that, in the third embodiment, the feed carrier 52 of the first embodiment is driven by a servomotor.

Figure 14:
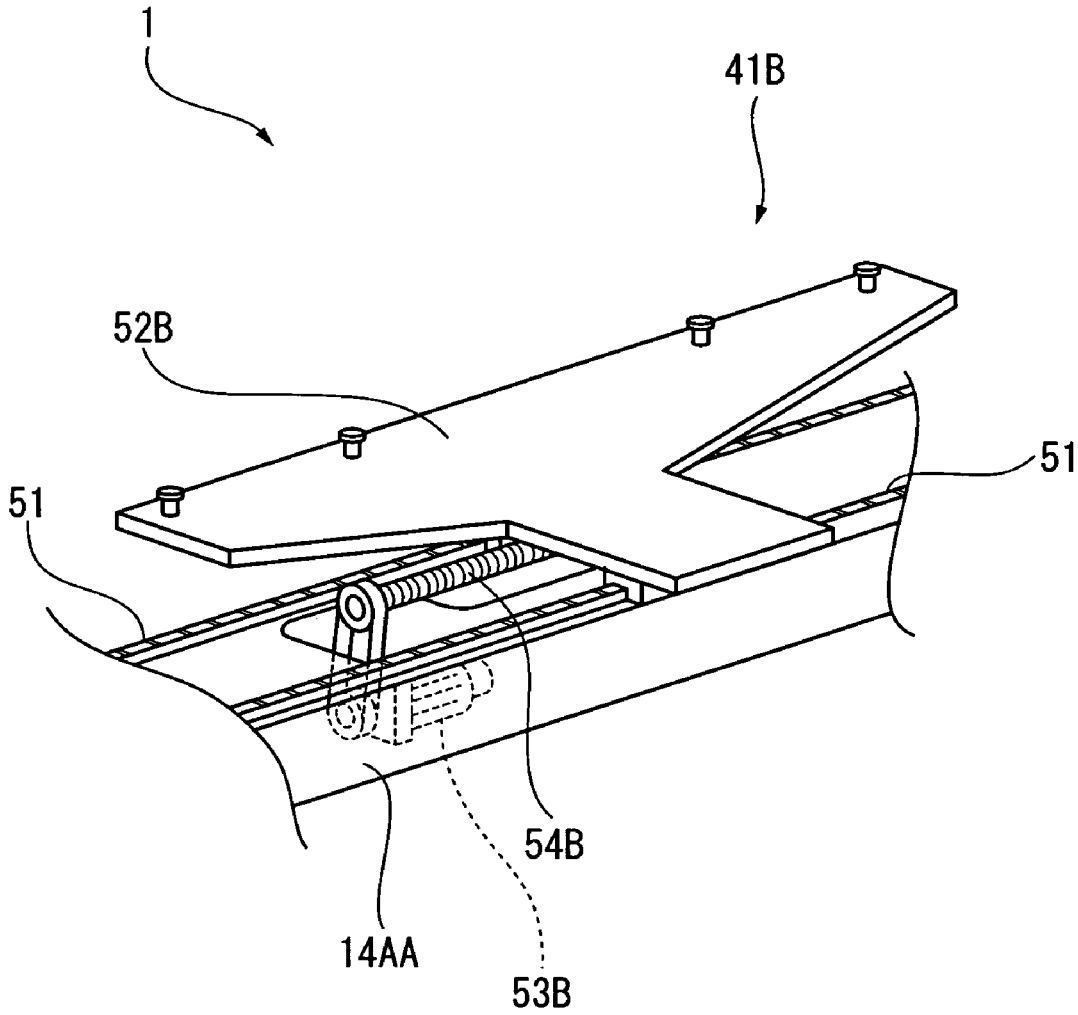
FIG. 14 is a perspective view showing a part of a work carrying device according to a third embodiment of the present invention.

FIG. 14 is a perspective view showing a part of a transfer feeder 41B according to the third embodiment. As shown in FIG. 14, similar to the first embodiment, a pair of bars 14AA are provided in parallel in the work transfer direction, and a plurality of feed carriers 52B are provided on a pair of feeding rails 51, 51 installed on the upper surface of the bar 14AA, the feed carrier 52B being individually movable. Note that though FIG. 14 shows only one feed carrier 52B, the number of the feed carrier 52B can be any according to necessity.

The feed carrier 52B, driven by a feeding servomotor (feed drive mechanism) 53B provided to the bar 14AA, performs a feed operation. The bar 14AA is provided with a ball screw 54B which is chain-driven by the feeding servomotor 53B, and when the ball screw 54B rotates, a ball nut (not shown) provided to the feed carrier 52B moves, so that the feed carrier 52B moves together with the ball nut. In this manner the feed carrier 52B performs the feed operation.

Since the feed carrier 52B is driven by the feeding servomotor 53B, the cost of the feed drive mechanism can be reduced. Also, since the ball screw mechanism is used for the power transmitting mechanism, maintenance and adjustment of the transfer feeder 41B and the transfer press 1 become easy. Incidentally, a rack and pinion mechanism or the like also can be used for the power transmitting mechanism of the feeding servomotor 53B.

Note that though the above embodiments are explained using an example in which a general purpose robot provided on the downstream side of the pressing machine is used for carrying out the work, the case also can be the one in which a general purpose robot provided on the upstream side of the pressing machine is used for carrying in the work, or the case can be the one in which two general purpose robots are provided respectively for carrying in and carrying out the work.

Figure 15:
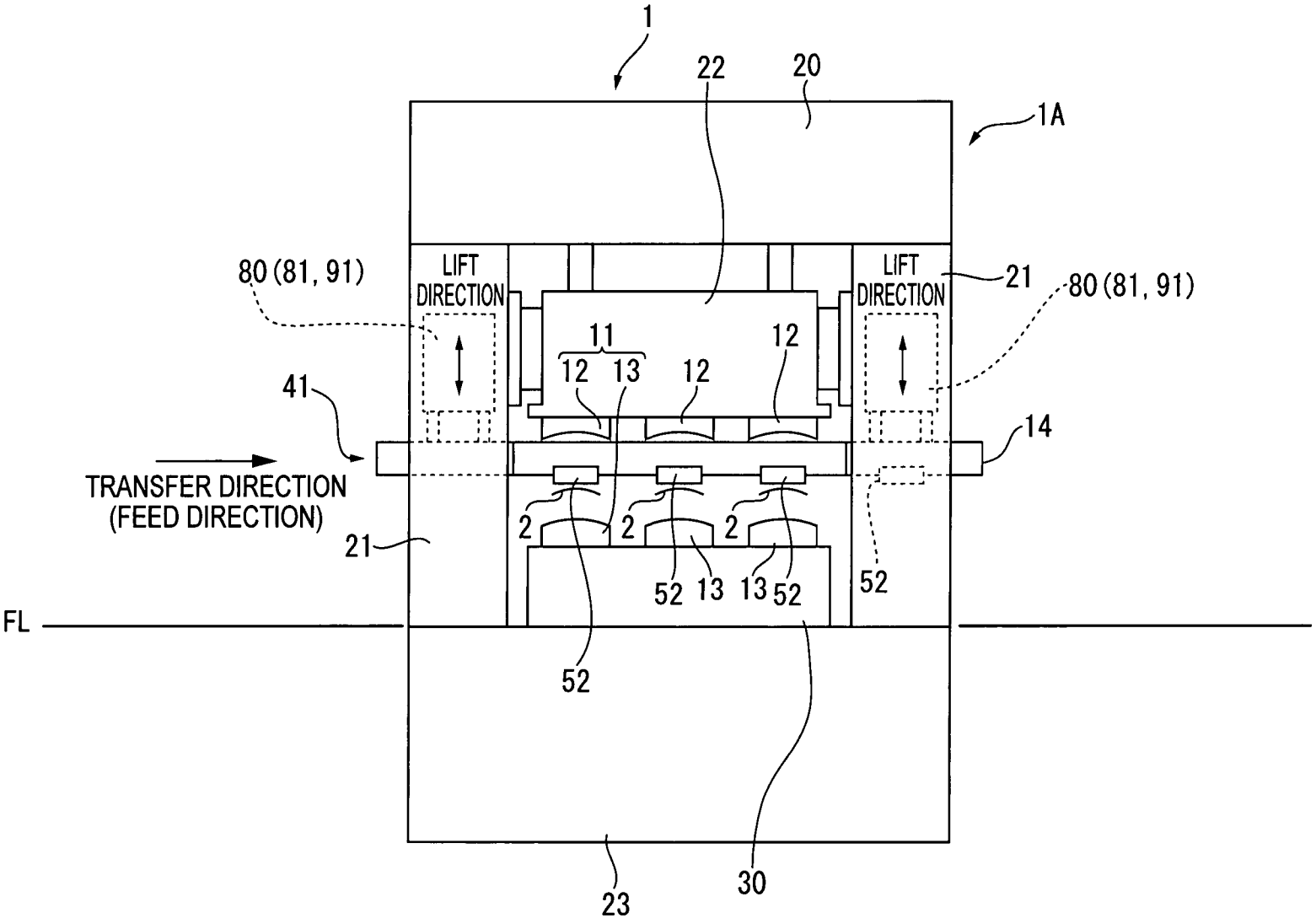
FIG. 15 is a front elevational view showing a modification of the work carrying device of the present invention.

Further, though the frames 33A are arranged on the bed in the above embodiments, the frames 33A also can be arranged above the bar 14 between the uprights 21 as shown in FIG. 15. In such a case, since the bar 14 is suspended, the feed carriers 52 are supported by the lower surface of the bar 14. By arranging the frames 33A in such a way, the visibility inside the transfer press 1 can be improved.

Fourth Embodiment

Figure 16:
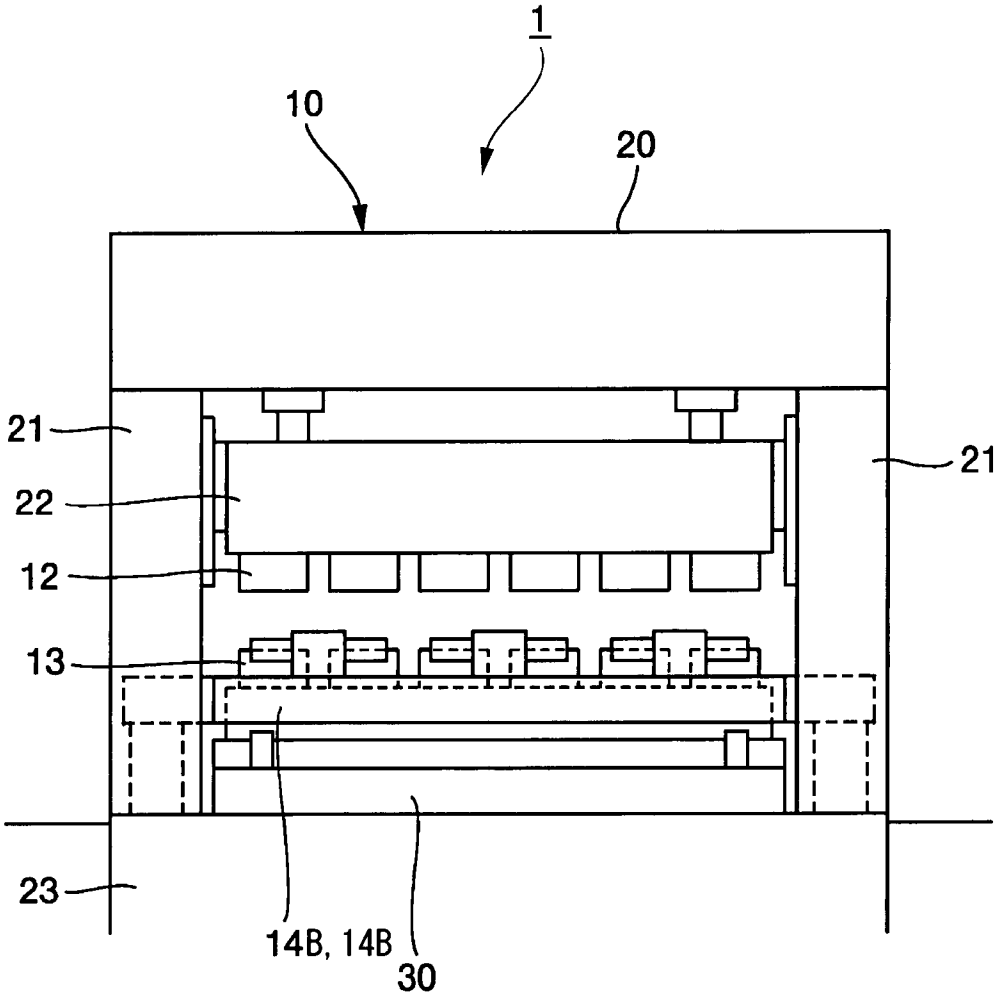
FIG. 16 is a front elevational view showing a pressing machine according to a fourth embodiment of the present invention.
Figure 17:
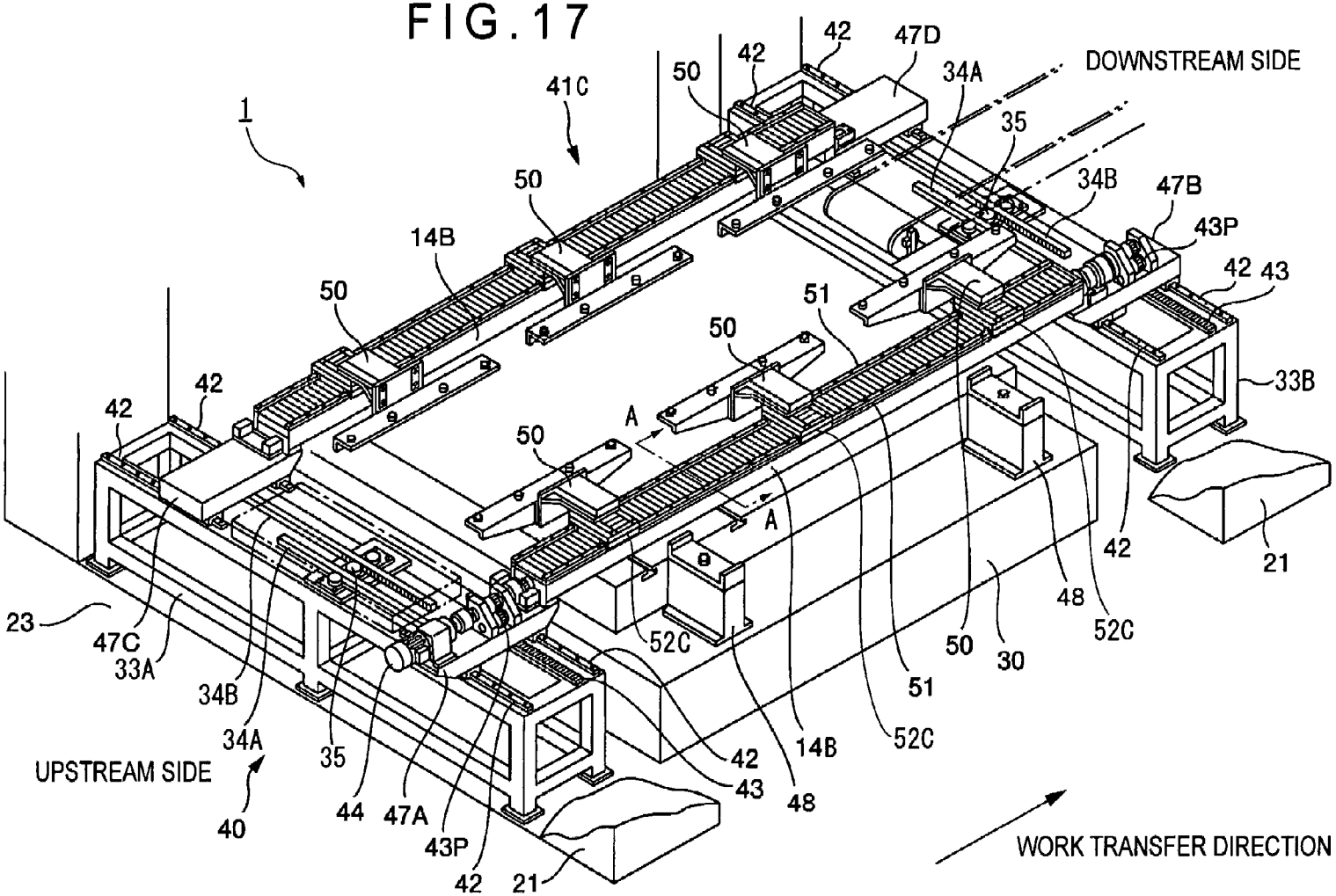
FIG. 17 is a perspective view showing a work carrying device according to the fourth embodiment of the present invention.
Figure 18:
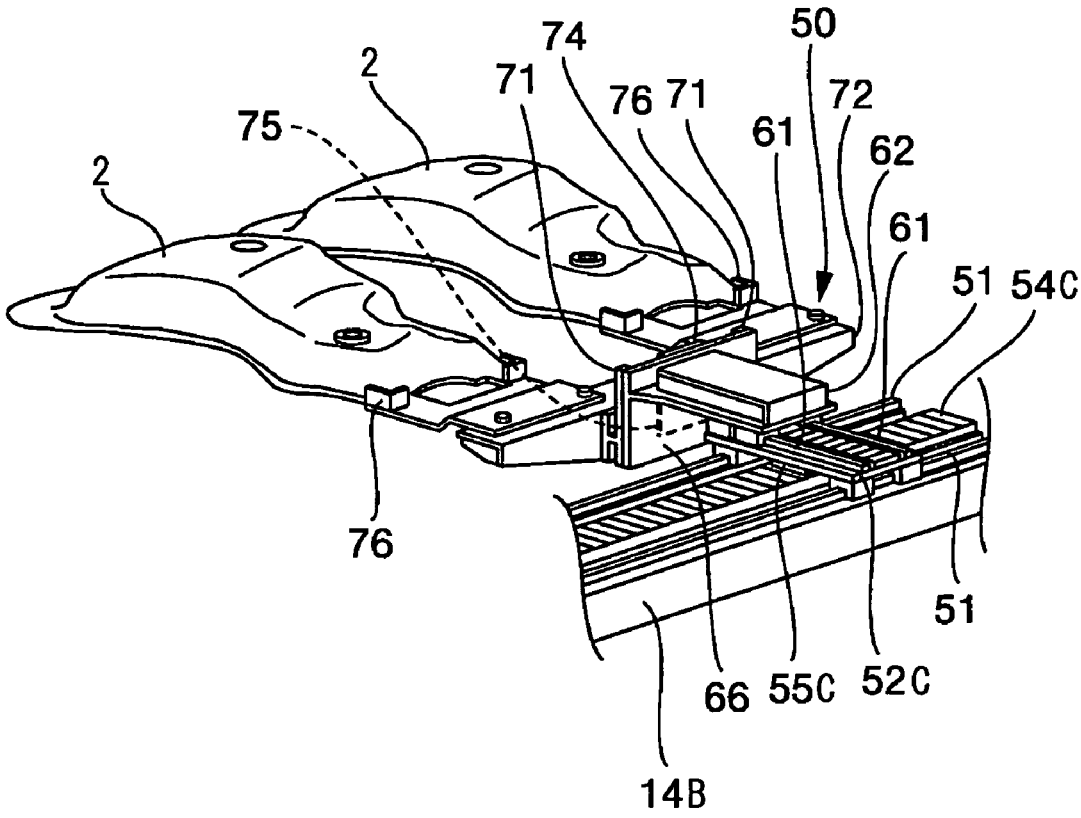
FIG. 18 is an enlarged perspective view showing a part of the work carrying device according to the fourth embodiment of the present invention.
Figure 19:
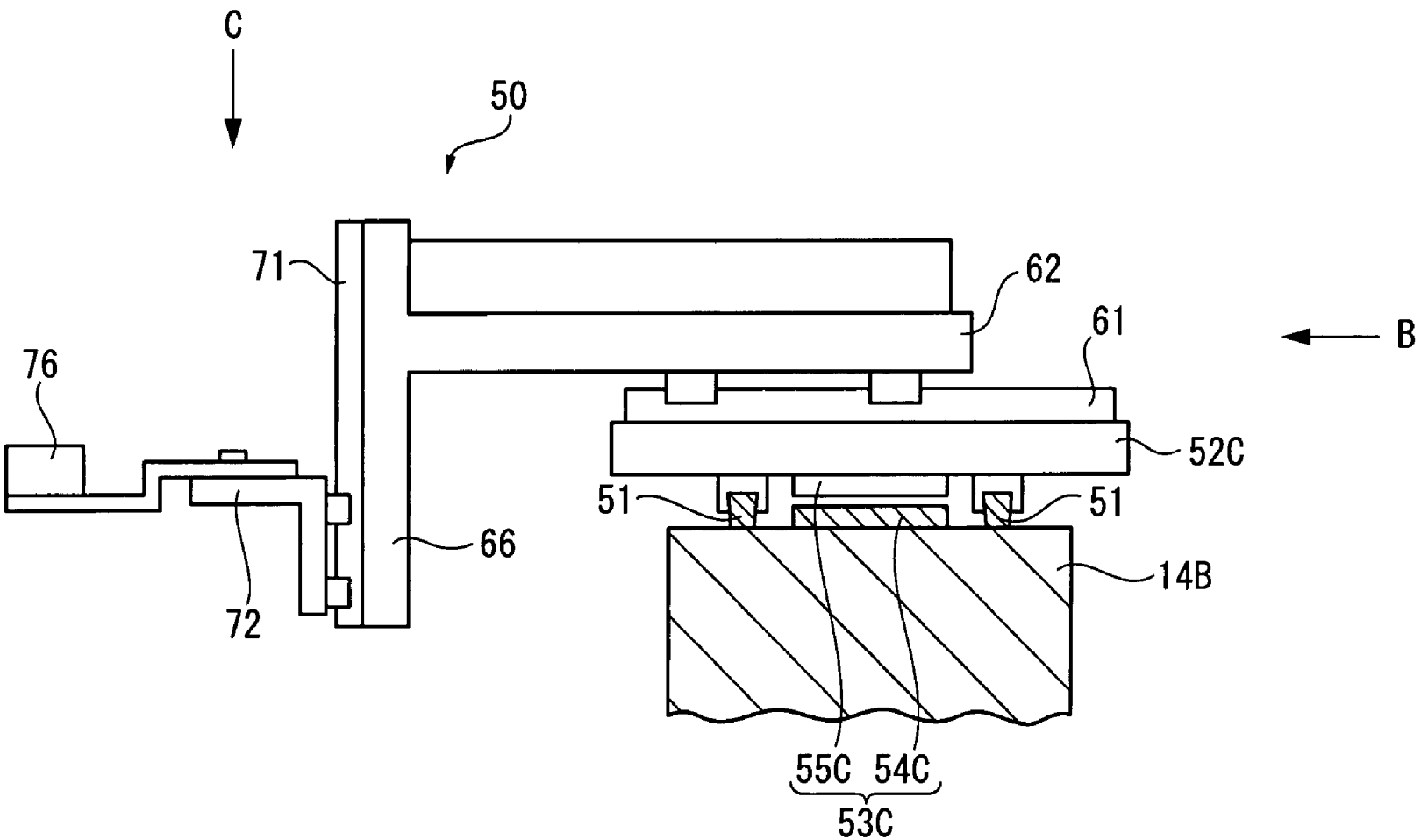
FIG. 19 is a cross section taken along line A-A of FIG. 17.
Figure 20:
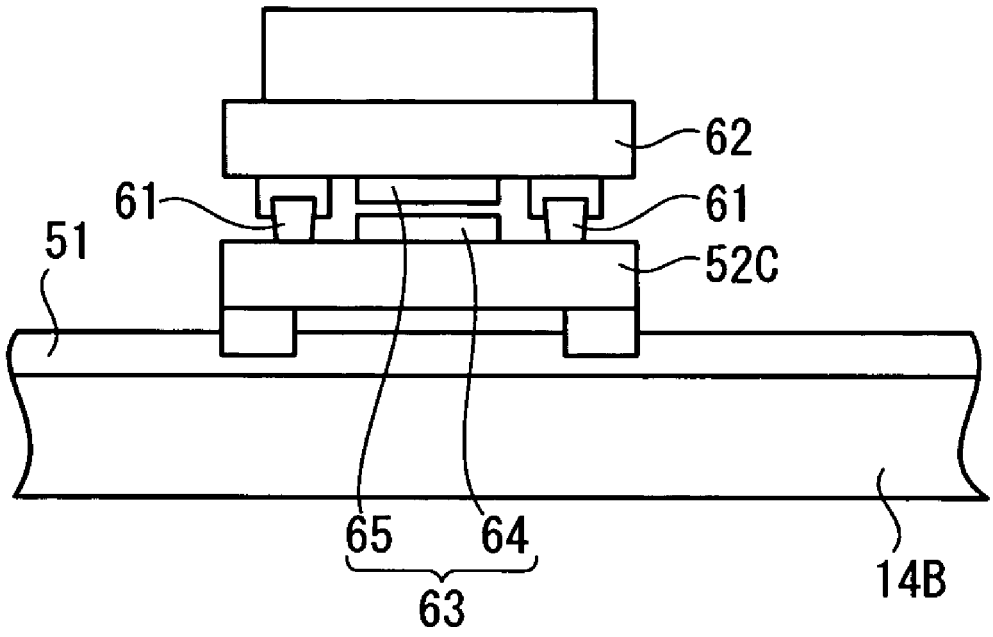
FIG. 20 is an elevational view viewed from the direction B of FIG. 19.
Figure 21:
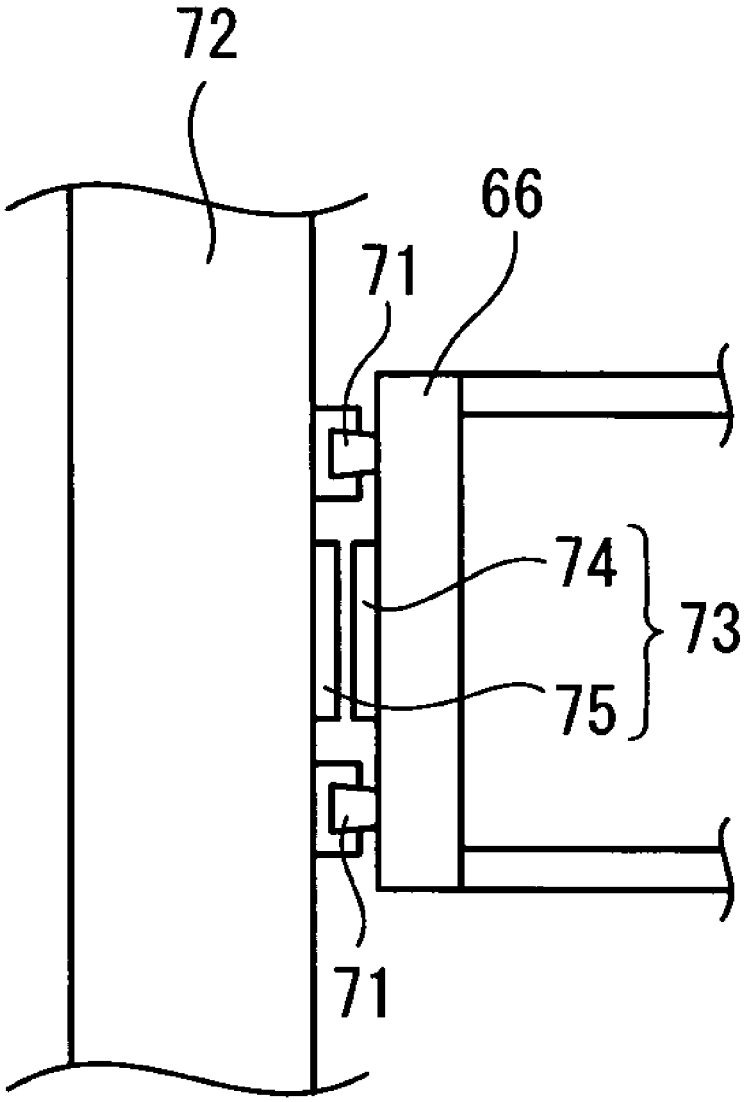
FIG. 21 is an elevational view viewed from the direction C of FIG. 19.

FIG. 16 is a front elevational view showing a transfer press (pressing machine) 1 having a work carrying device according to a fourth embodiment of the present invention. FIG. 17 is a perspective view showing a transfer feeder 41C which is the work carrying device. FIG. 18 is an enlarged perspective view showing a part of the transfer feeder 41C. FIGS. 19 to 21 are partly enlarged views of the transfer feeder 41C. Note that like components are denoted by like numerals as of the first to third embodiments, and the explanation thereof will be omitted.

As shown in FIG. 16, four columnar uprights 21 are erected on a bed 23 disposed in the lower portion of a press frame 10 of the transfer press 1, and a crown 20 is provided above the uprights 21. A slide drive device is built into the crown 20 for driving a slide 22 disposed below the crown 20 upward and downward. Upper dies 12 are installed to a lower surface of the slide 22. Lower dies 13 are installed to an upper surface of a moving bolster 30 opposed to the slide 22, so that a work is press-formed by cooperation of the upper dies 12 with the lower dies 13. A pair of bars 14B, 14B are provided on the right and left with the upper dies 12 and the lower dies 13 sandwiched therebetween, the pair of bars 14B, 14B extending in parallel in the work transfer direction.

As shown in FIG. 17, on the bed 23, an upstream frame 33A and a downstream frame 33B are respectively provided between the two uprights 21 on the upstream side and between the two uprights 21 on the downstream side, both frames being arranged along the direction perpendicular to the work transfer direction. Each of the upstream frame 33A and the downstream frame 33B is provided with two pairs of moving rails 42, which are parallel with each other in the direction perpendicular to the work transfer direction. Supports 47A, 47B, 47C, and 47D respectively provided on the lower sides at both ends of the bars 14B, 14B can move on the moving rails 42. Thus the bar 14B, 14B are supported by the frames 33A, 33B located on both sides of the moving bolster 30 across the moving bolster 30, in a manner of being movable in the direction perpendicular to the work transfer direction.

Racks 43 are respectively provided near the pairs of the moving rails 42 on the front side in parallel with the moving rails 42, the racks 43 being respectively engaged with the pinions 43P, 43P respectively provided on the supports 47A, 47B. The supports 47A, 47B are respectively provided with interlocking racks 34A, 34A parallel with the moving rail 42 and extending toward the opposing supports 47C, 47D, the interlocking racks 34A, 34A respectively engaging with interlocking pinions 35, 35 respectively provided at substantially centers of the frames 33A, 33B. Further, the supports 47C, 47D are respectively provided with interlocking racks 34B, 34B parallel with the moving rail 42 and extending toward the opposing supports 47A, 47B, the interlocking racks 34B, 34B respectively engaging with interlocking pinions 35, 35.

When a driving shaft (not shown) passed through the bar 14B in the longitudinal direction is rotated by a moving motor 44 provided to the support 47A, the pinions 43P, 43P rotate, gear-driven by the driving shaft. Thus, since the pinions 43P, 43P respectively engage with the racks 43, 43, the bar 14B on the front side moves along with the supports 47A, 47B. When the interlocking racks 34A, 34A are also moved at the same time, since the interlocking pinions 35, 35 are respectively engaged with the interlocking racks 34B, 34B, the interlocking racks 34B, 34B also move, so that the bar 14B on the back side moves along with the supports 47C, 47D.

Thus a bar interval adjustment device 40 of the present invention is configured by the interlocking racks 34A, 34B and the interlocking pinion 35, the bar interval adjustment device 40 being capable of adjusting the interval between the pair of bars 14B, 14B (that is, the bar 14B on the front side and the bar 14B on the back side when viewed from FIG. 17). With the bar-interval adjusting device 40, it becomes possible to flexibly cope with various kinds of press working by adjusting the interval between the pair of bars 14B, 14B corresponding to the die, therefore versatility of the transfer press 1 can be expanded.

As shown in FIGS. 17 and 18, a pair of feeding rails 51, 51 are provided on an upper surface of each of the bars 14B, 14B, and a plurality of feed carriers 52C are movably provided on the pair of feeding rails 51, 51. Though there are three feed carriers 52C in the first embodiment, the number of the feed carrier 52C can be one, two, four or more than four according to necessity.

The feed carrier 52C, driven by a feeding linear motor (feed drive mechanism) 53C (refer to FIG. 19), performs a feed operation. Herein, the feed operation means an operation in which the feed carrier 52C moves along a feed direction. Further, the feed direction means a direction parallel to the work transfer direction.

FIG. 19 is a cross section taken along line A-A of FIG. 17. As also shown in FIGS. 19 and 18, the feeding linear motor 53C has a magnet plate 54C as a fixed part provided between the pair of the feeding rails 51, 51, and a coil plate 55C as a movable part provided on a lower surface of the feed carrier 52C, the coil plate 55C being opposed to the magnet plate 54C. When a current flows so that a shifting magnetic field is generated to the coil plate 55C, the coil plate 55C will move due to the attraction and repulsion force against the magnet plate 54C. The feed carrier 52C is moved along with the coil plate 55C, thus the feed carrier 52C is forced to perform a feed operation. Since each of the feed carriers 52 is provided with the feeding linear motor 53, the plurality of the feed carriers 52 can be individually moved on the feeding rails 51, 51 in the feed direction, and the movement of the respective feed carriers 52 can be individually controlled.

As shown in FIGS. 17, 18 and 19, a pair of clamping rails 61, 61 are provided on an upper surface of the feed carrier 52C in a horizontal direction perpendicular to the feeding rail 51, and a clamp carrier 62 is movably provided on the pair of clamping rails 61, 61. The clamp carrier 62, driven by a clamping linear motor (clamp drive mechanism) 63 (refer to FIG. 20), performs a clamp operation. Herein, the clamp operation means an operation in which the clamp carrier 62 moves along a clamp direction. Further, the clamp direction means a horizontal direction perpendicular to the feed direction, namely a direction in which a pair of opposed clamp carriers 62 move toward or away from each other.

FIG. 20 is an elevational view viewed from the direction B of FIG. 19. As also shown in FIGS. 19 and 20, the clamping linear motor 63 has a magnet plate 64 as a fixed part provided between the pair of the clamping rails 61, 61, and a coil plate 65 as a movable part provided on a lower surface of the clamp carrier 62, the coil plate 65 being opposed to the magnet plate 64. When a current flows so that a shifting magnetic field is generated to the coil plate 65, the coil plate 65 will move due to the attraction and repulsion force against the magnet plate 64. The clamp carrier 62 is moved along with the coil plate 65, thus the clamp carrier 62 is forced to perform clamp operation.

As shown in FIGS. 17 and 18, a pair of lifting rails 71, 71 extending in the vertical direction are provided on a back-side surface (see FIG. 17) of a L-shaped bracket 66 of the clamp carrier 62 (mutually facing surfaces of a pair of the L-shaped brackets 66 of the clamp carriers 62), and a lift carrier 72 is movably provided on the pair of lifting rails 71, 71. The lift carrier 72, driven by a lifting linear motor (lift drive mechanism) 73 (refer to FIG. 21), performs a lift operation. Herein, the lift operation means an operation in which the lift carrier 72 moves along a lift direction. Further, the lift direction means a direction perpendicular to both the feed direction and the clamp direction, namely a direction in which the lift carrier 72 moves vertically.

FIG. 21 is an elevational view viewed from the direction C of FIG. 19. As also shown in FIGS. 19 and 21, the lifting linear motor 73 has a magnet plate 74 as a fixed part provided between the pair of the lifting rail 71, 71, and a coil plate 75 as a movable part provided on a front surface (viewed from FIG. 17) of the lift carrier 72, the coil plate 75 being opposed to the magnet plate 74. When a current flows so that a shifting magnetic field is generated to the coil plate 75, the coil plate 75 will move due to the attraction and repulsion force against the magnet plate 74. The lift carrier 72 is moved along with the coil plate 75, thus the lift carrier 72 is forced to perform lift operation.

As shown in FIGS. 17 and 19, fingers 76, 76 as work holders for holding works 2, 2 are detachably installed to the lift carrier 72. In the fourth embodiment, similar to the first embodiment, the lift carrier 72 is provided with two fingers 76, 76 as shown in FIG. 5. By performing the clamp operation, two works 2, 2 (refer to FIG. 18) can be simultaneously clamped with the two fingers 76, 76 and the other two fingers 76, 76 (not shown) of the lift carrier 72 on the opposing side.

Herein, since the fingers 76, 76 are provided to the lift carrier 72 and the lift carrier 72 is provided to the clamp carrier 62, the fingers 76, 76 can move both in the lift direction and the clamp direction, so that in the fourth embodiment, the lift carrier 72 and the clamp carrier 62 are equivalents to a base 50 of the present invention.

Since the lift carrier 72 is provided with plural (the number corresponding to the number of working processes) fingers 76, 76 to hold the plural works 2, the number of the feeding linear motor 53C, the clamping linear motor 63, and the lifting linear motor 73 can be reduced, the construction of the transfer feeder 41C can be simplified, and the manufacturing cost can be reduced.

Incidentally, in the fourth embodiment, though the finger 76, which positions and mounts the work 2, is used for the work holder for holding the work 2, the work holder is not limited thereto, and for example a gripper 77, as shown in FIG. 7, of the first embodiment for gripping the work 2 can be used. Further, in the fourth embodiment, though the lift carrier 72 is provided with two fingers 76, 76, the number of the fingers 76 can be one, three, or more than three, corresponding to the die.

Similar to the described above, the other bar 14B is provided with feed carriers 52C, clamp carriers 62, and lift carriers 72, and all these components respectively perform, driven by respective linear motors, the feed operation (for performing a movement parallel to the work transfer direction), the clamp operation (for performing a horizontal movement perpendicular to the feed direction), and the lift operation (for performing a movement in the vertical direction).

Further, though the description is based on the configuration in which the magnet plate of each linear motor is a fixed part and the coil plate is a movable part, the configuration also can be the one in which the magnet plate is a movable part and the coil plate is a fixed part.

The operation of the work carrying device in the fourth embodiment will be described below with reference to FIG. 17 and FIG. 9 described above. The operation will be described based on a case where a work is transferred from a first working process to a second working process.

(1) First, the work 2 is pressed in the first working process, and the slide 22 starts to rise.

At this time, the lift carrier 72 with the fingers 76 fixed thereon is in a down position (at the downward end of a lift stroke). Further, the clamp carrier 62 that holds the lift carrier 72 is in an unclamp position (at outward end of a clamp stroke). When the clamp carrier 62 is driven by the clamping linear motor 63, the clamp carrier 62 performs a clamp motion along the clamping rails 61, 61 from the unclamp position toward a clamp position (at inward end of the clamp stroke), so that the work 2 on the lower die 13 of the first working process is mounted on the fingers 76.

(2) Next, in the state where the work 2 is mounted on the fingers 76, when the lift carrier 72 is driven by the lifting linear motor 73, the lift carrier 72 performs a lift motion from the downward position to a lift position (at the upward end of the lift stroke). Further, when the feed carrier 52C is driven by the feeding linear motor 53C, the feed carrier 52C that holds the clamp carrier 62 is subjected to a controlled drive to perform a feed motion. Consequently, the work 2 mounted on the fingers 76 is transferred from the first working process to the second working process.

(3) Upon the work 2 reaches the second working process, the lift carrier 72 is driven by the lifting linear motor 73, so that the lift carrier 72 is moved to the down position to set the work 2 onto the lower die 13 of the second working process.

(4) After the work 2 is set onto the lower die 13, when the clamp carrier 62 is driven by the clamping linear motor 63, the clamp carrier 62 performs an unclamp motion from the clamp position to the unclamp position, so that the fingers 76 are retreated from the work 2. Further, when the feed carrier 52C is driven by the feeding linear motor 53C, the feed carrier 52C performs a return motion from the second working process to the first working process until reaching the initial first working process again.

Incidentally, after the fingers 76 are moved to the unclamp position to retreat from the area of interfering with the upper die 12, the slide 22 is descended, so that a predetermined press working of the second working process is performed by clamping the work 2 between the upper die 12 attached on the lower surface of the slide 22 and the lower die 13 and applying pressure.

As described above, the transfer feeder 41C of the fourth embodiment is provided with the feed carrier 52C movable relative to the bars 14B, 14B in the feed direction, the clamp carrier 62 movable relative to the feed carrier 52C in the clamp direction, and the lift carrier 72 movable relative to the clamp carrier 62 in the lift direction. All these components are driven by the respective linear motors so as to respectively perform, in a reciprocating manner, the feed/return motion in the feed direction, the clamp/unclamp motion in the clamp direction (i.e., the horizontal direction perpendicular to the feed direction), and the rising/descending motion (i.e., the lift/down motion) in the vertical direction. All these motions constitute a three-dimensional operation. By appropriately reciprocating the work holder held on the lift carrier 72 in the feed direction, the lift direction and the clamp direction, the work 2 is sequentially transferred from the lower die 13 on an upstream side (the left side in FIG. 16) to the lower die 13 on a downstream side (the right side in FIG. 16).

Since the feed carriers 52C are movably provided on the bars 14B, 14B, the object to be driven by the feed drive mechanism becomes small. Accordingly, different from the conventional art, since the feed drive mechanism can be made small, and the feed box having a feed drive section housed therein becomes unnecessary, there is no feed box projected from the lateral surface of the press main body, so that the transfer press 1 as a whole can be downsized. Further, since no feed box is projected, a work carrying-out device or the like can be provided in the vicinity of the transfer press 1.

When performing die changing, since respective fingers 76 are also need to be changed corresponding to the die, the fingers 76, 76 need to be mounted on the moving bolster 30 together with the bars 14B, 1413 so as to be moved out from the work transfer 10 area. Herein, though the bars 14B, 14B themselves can be moved out from the work transfer area after passing through the space between the uprights 21, the bar interval adjustment devices 40 connected to the bars 14B, 14B on the upstream and downstream sides are obstacles to moving out the bars 14B, 14B since the bar interval adjustment devices 40 are respectively arranged on the frames 33A between the two uprights 21 on the upstream side and on the frames 33B between the two uprights 21 on the downstream side.

To solve this problem, the bars 14B, 14B can be split from the bar interval adjustment device 40 (including the driving shaft), so that the bars 14B, 14B are split from the bar interval adjustment device 40 when performing die changing. Namely, in the fourth embodiment, the bars 14B, 14B can be split into fixed bars fixed to the bar interval adjustment devices 40, and movable bars capable of being split from the fixed bars, so that the bars 14B, 14B can be detached from the bar interval adjustment devices 40. Thus the bars 14B, 14B can be detached from the frames 33A, 33B.

Incidentally, as shown in FIG. 17, the moving bolster 30 is provided with bar receiving tables 48 equipped with elevating/lowering devices, and, similar to the first embodiment, the split, bars 14B, 14B are supported by the bar receiving tables 48 as shown in FIG. 12.

Incidentally, the bar receiving tables 48 are provided with drive sections for moving the bars 14B, 14B in the clamp direction, so that when exchanging the die mounted on the moving bolster 30 while performing die changing outside the press main body, die changing operation can be further facilitated by widening the bar interval.

Fifth Embodiment

Figure 22:
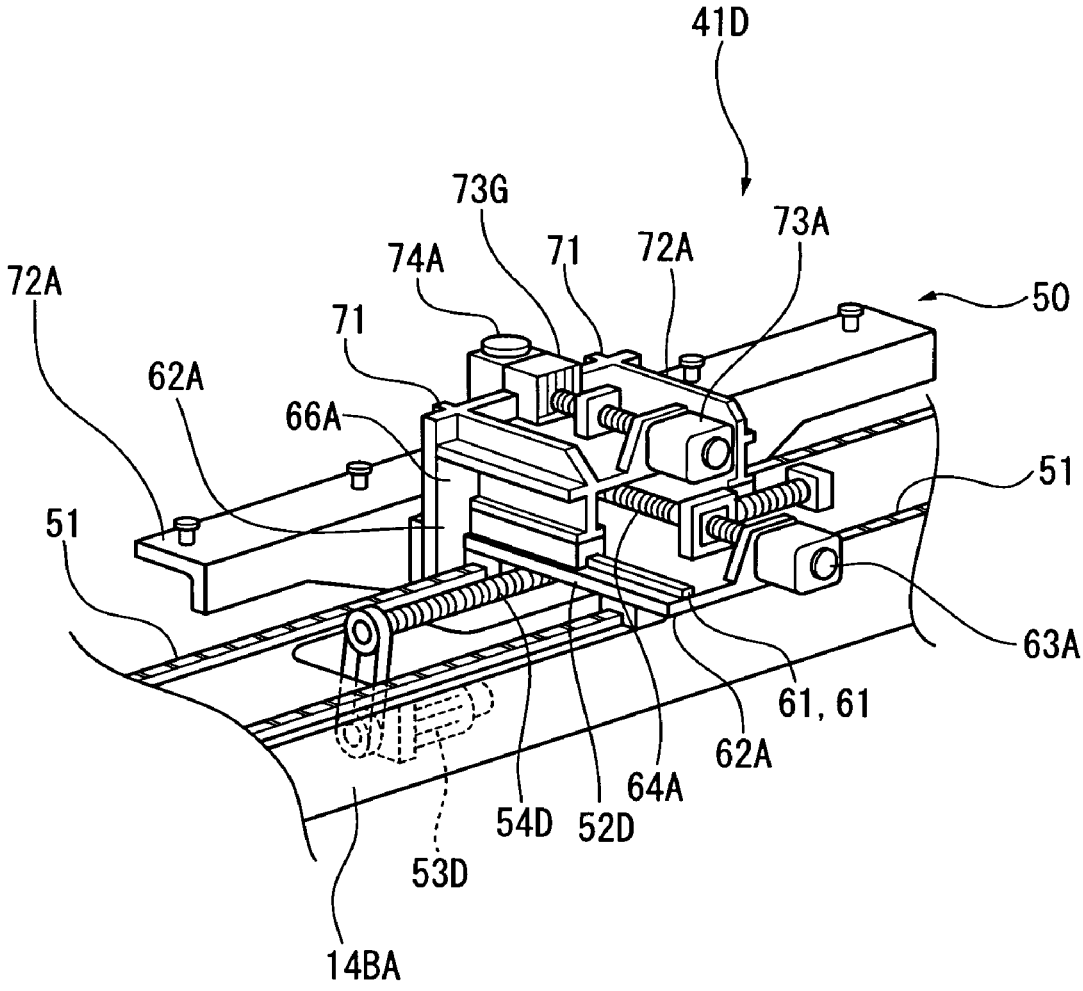
FIG. 22 is a perspective view showing a part of a work carrying device according to a fifth embodiment of the present invention.

Next, a transfer feeder 41D of a fifth embodiment will be described below with reference to FIG. 22. FIG. 22 is a perspective view showing a part of the transfer feeder 41D. Since the fifth embodiment differs from the fourth embodiment in that the feed carrier 52C, the clamp carrier 62, and the lift carrier 72 of the fourth embodiment are driven by servomotors, these portions will be described with reference to FIG. 22. Also, since other portions are similar to those of the fourth embodiment, like components are denoted by like numerals as of the first to fourth embodiments, and the explanation thereof will be omitted.

As shown in FIG. 14, similar to the fourth embodiment, a pair of bars 14BA are provided in parallel in the work transfer direction, and a plurality of feed carriers 52D are provided on a pair of feeding rails 51, 51 installed on the upper surface of each bar 14BA, the feed carriers 52D being individually movable. Note that though FIG. 22 shows only one feed carrier 52D, the number of the feed carrier 52D can be any according to necessity.

The feed carrier 52D, driven by a feeding servomotor (feed drive mechanism) 53D provided to the bar 14BA, performs a feed operation. The bar 14BA is provided with a ball screw 54D which is chain-driven by the feeding servomotor 53D, and when the ball screw 54D rotates, a ball nut (not shown) provided to the feed carrier 52D moves, so that the feed carrier 52D moves together with the ball nut. In this manner the feed carrier 52D performs a feed operation.

A pair of clamping rails 61, 61 are provided on an upper surface of the feed carrier 52D in a horizontal direction perpendicular to the feeding rail 51, and a clamp carrier 62A is movably provided on the pair of clamping rails 61, 61. The clamp carrier 62A, driven by a clamping servomotor (clamp drive mechanism) 63A provided to the feed carrier 52D, performs a clamp operation.

The feed carrier 52A is provided with a ball screw 64A which is driven by the clamping servomotor 63A, and when the ball screw 64A rotates, a ball nut (not shown) provided to the clamp carrier 62A moves, so that the clamp carrier 62A moves together with the ball nut. In this manner the clamp carrier 62A performs clamp operation.

A pair of lifting rails 71, 71 extending in the vertical direction are provided on the back-side surface (seen from FIG. 22) of an L-shaped bracket 66A of the clamp carrier 62A, and a lift carrier 72A is movably provided on the pair of lifting rails 71, 71. The lift carrier 72A, driven by a lifting servomotor (lift drive mechanism) 73A, performs a lift operation.

The lifting servomotor 73A drives a ball screw 74A, which is rotatably provided to the lift carrier 72A, via a gear box 73G provided to the lift carrier 72A. When the ball screw 74A rotates, a ball nut (not shown) provided to the lift carrier 72A moves, so that the lift carrier 72A moves together with the ball nut. In this manner the lift carrier 72A performs lift operation. The present embodiment is similar to the first to fourth embodiments in that the lift carrier 72A is detachably installed with a pair of fingers as a work holder for holding a work, and the description in this regard will be omitted.

Also, the present embodiment is similar to the first to fourth embodiments regarding the operations of the feed carrier 52D, the clamp carrier 62A, and the lift carrier 72A, and the description in these regards will also be omitted.

Similar to the described above, the other bar (not shown) is also correspondingly provided with feed carriers, lift carriers, and clamp carriers, and all these components respectively perform, driven by respective servomotors, the feed operation, the lift operation, and the clamp operation.

As described above, the transfer feeder 41D of the fifth embodiment is provided with the feed carrier 52D movable relative to the bar 14BA in the feed direction, the clamp carrier 62A movable relative to the feed carrier 52D in the clamp direction, and the lift carrier 72A movable relative to the clamp carrier 62A in the lift direction. All these components are driven by the respective servomotors to respectively perform the feed operation, the clamp operation, and the lift operation under the control of a controller (not shown), so that consequently the transfer feeder 41D operates as a three-dimensional transfer feeder. By appropriately reciprocating the work holder held on the lift carrier 72 in the feed direction, the clamp direction and the lift direction, the work 2 is sequentially transferred from the lower die 13 on an upstream side (the left side in FIG. 16) to the lower die 13 on a downstream side (the right side in FIG. 16).

Sixth Embodiment

Figure 23:
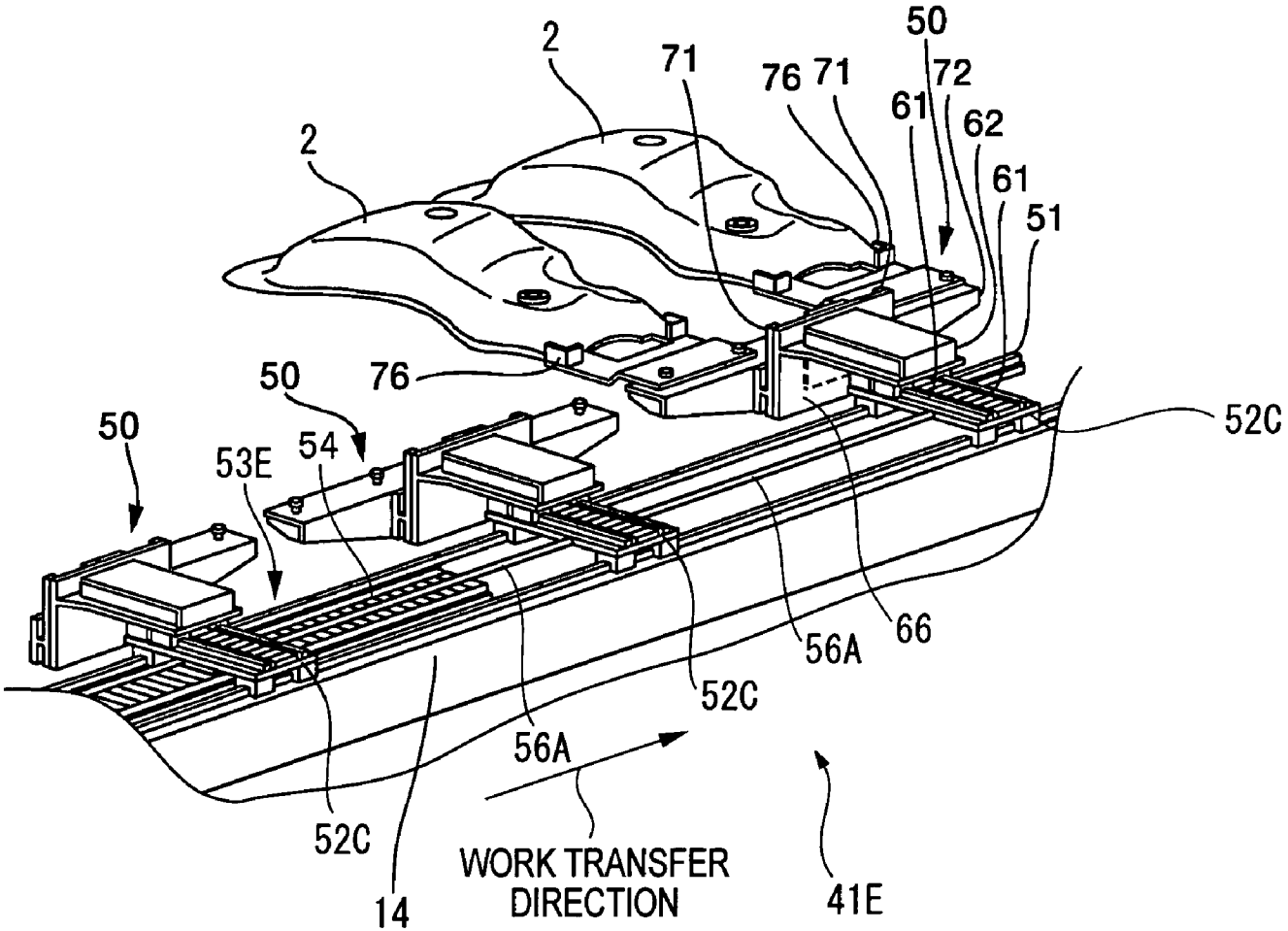
FIG. 23 is a perspective view showing a work carrying device according to a sixth embodiment of the present invention.

Next, a transfer feeder 41E of a sixth embodiment will be described below with reference to FIG. 23. FIG. 23 is a perspective view showing a part of the transfer feeder 41E which is the work carrying device. Note that like components are denoted by like numerals as of the first to fifth embodiments, and the explanation thereof will be omitted.

The sixth embodiment differs from the fourth embodiment in that the adjacent feed carriers 52C are connected to each other via a connector 56A. Accordingly, the plurality of feed carriers 52C are so arranged that the adjacent feed carriers 52C are connected to each other with a predetermined interval. With such an arrangement, since all of feed carriers 52C supported by the single bar 14 are operated in an interlocked manner, it is unnecessary to provide a feed drive mechanism for each of the feed carriers 52C. FIG. 23 shows a case where only the feed carrier 52C on the upstream side is provided with a linear motor (a feed drive mechanism) 53E.

Incidentally, the configuration also can be the one in which all of the feed carriers 52C are respectively provided with linear motors as in the fourth embodiment, and all of the linear motors are simultaneously driven.

The present embodiment is similar to the fourth embodiment regarding the operation of the transfer feeder 41E, and the description in this regard is omitted.

Seventh Embodiment

Figure 24:
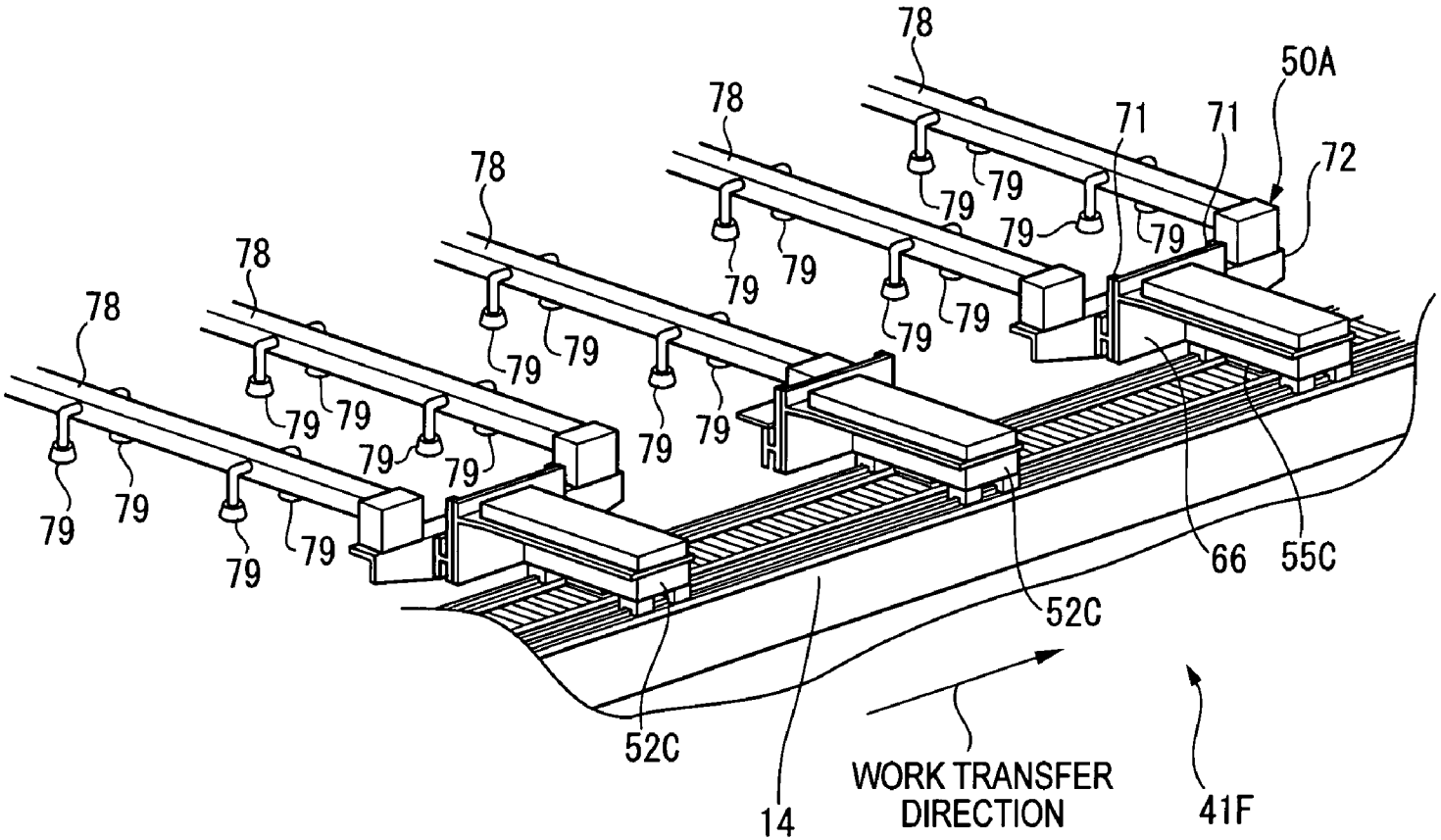
FIG. 24 is a perspective view showing a work carrying device according to a seventh embodiment of the present invention.

Next, a transfer feeder 41F of a seventh embodiment will be described below with reference to FIG. 24. FIG. 24 is a perspective view showing a transfer feeder 41F which is the work carrying device. Note that like components are denoted by like numerals as of the first to sixth embodiments, and the explanation thereof will be omitted.

The seventh embodiment differs from the fourth embodiment in that the clamping linear motor 63 is eliminated, and the lift carrier 72 is held by the feed carrier 52C. With such an arrangement, carriers 72 respectively provided on the pair of bars 14 are paired with each other with a constant interval therebetween, and cross bars 78 are horizontally stretched between the pairs of lift carriers 72. The cross bar 78 is provided with vacuum cups (work holders) 79 for sucking and holding the work by negative pressure. In the seventh embodiment, since the vacuum cups 79 are held by the lift carrier 72 via the cross bar 78, and the lift carrier 72 can move in the lift direction, so that the lift carrier 72 is equivalent to a base 50A of the present invention.

With such a configuration, the feed carrier 52C performs the feed motion and the lift carrier 72 performs the lift motion, therefore the transfer feeder 41F of the seventh embodiment can perform two-dimensional operation.

Figure 25:
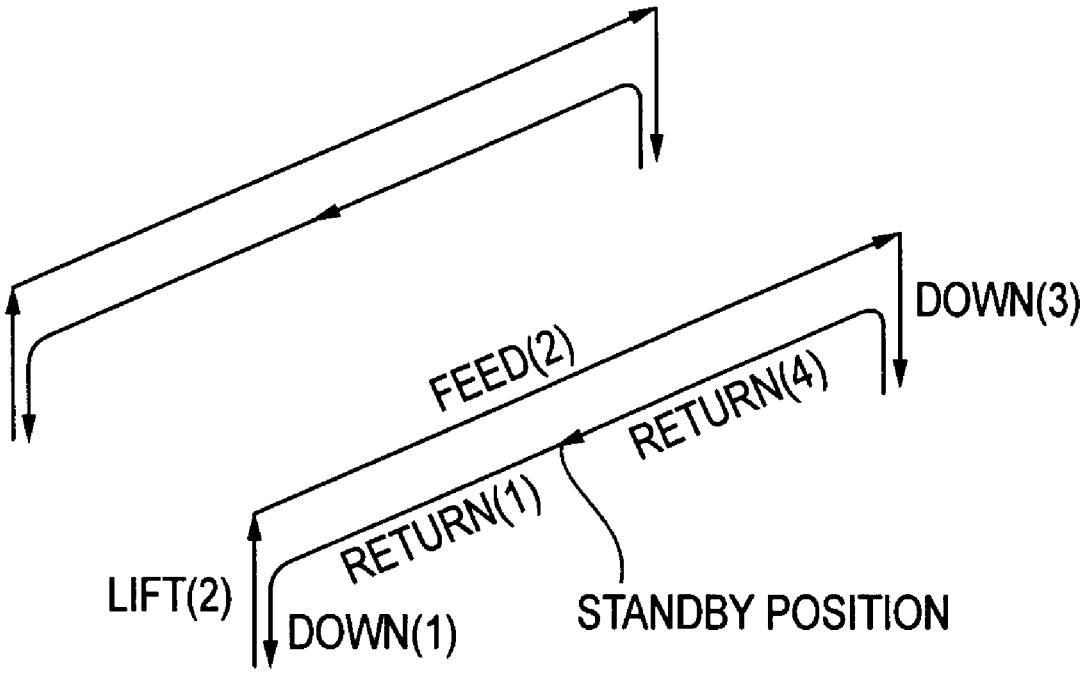
FIG. 25 is an illustration explaining the motion of a work holder according to the seventh embodiment of the present invention.

The operation of the work carrying device in the seventh embodiment will be described below with reference to FIG. 24 and FIG. 25 that explains the motion of the seventh embodiment. The operation will be described based on a case where a work is transferred from a first working process to a second working process.

(1) First, the work 2 is pressed in the first working process, and the slide 22 starts to rise.

At this time, the cross bar 78 provided on the lift carrier 72 is in a standby position in the middle between the first working process and the second working process. In the standby position, the lift carrier 72 is in a lift position (at the upward end of a lift stroke). After the press working is finished, the feed carrier 52C that holds the lift carrier 72 is subjected to a controlled drive to perform a return motion toward the side of the first working process. And the cross bar 78 is moved from the standby position to the first working process.

Next, the lift carrier 72 is descended to a down position (at the downward end of a lift stroke), and the work 2 on the lower die 13 of the first working process is sucked and held by the vacuum cups 79 of the cross bar 78.

(2) Next, in the state where the work 2 is sucked and held by the vacuum cups 79, the lift carrier 72 performs lift motion to a lift position (at the upward end of a lift stroke). Further, the feed carrier 52C is subjected to a controlled drive to perform a feed motion. Thus the work 2 sucked and held by the vacuum cup 79 is transferred from the first working process to the second working process.

(3) Upon the work 2 reaches the second working process, the lift carrier 72 is moved to the down position to set the work 2 onto the lower die 13 of the second working process. And the sucking force of the vacuum cup 79 is released.

(4) After the work 2 is set onto the lower die 13, the lift carrier 72 is moved to the lift position and the feed carrier 52C is subjected to a controlled drive to perform a return motion toward the initial standby position.

Incidentally, after the cross bar 78 is moved to the standby position and retreated from the area of interfering with the upper die 12, the slide 22 is descended, so that a predetermined press working of the second working process is performed by clamping the work 2 between the upper die 12 attached on the lower surface of the slide 22 and the lower die 13 and applying pressure.

As described above, the transfer feeder 41F of the seventh embodiment is provided with the feed carrier 52C movable relative to the bar 14 in the feed direction, and the lift carrier 72 movable relative to the feed carrier 52C in the lift direction. All these components are driven by the respective linear motors to respectively perform, in a reciprocating manner, the feed/return motion in the feed direction, and the rising/descending motion in the vertical direction. All these motions constitute a two-dimensional operation. By appropriately reciprocating the cross bar 78 installed to the lift carrier 72 and the vacuum cups 79 installed to the cross bar 78 in the feed direction and the lift direction, the work 2 is sequentially transferred from the lower die 13 on an upstream side (the left side in FIG. 24) to the lower die 13 on a downstream side (the right side in FIG. 24).

Figure 26:
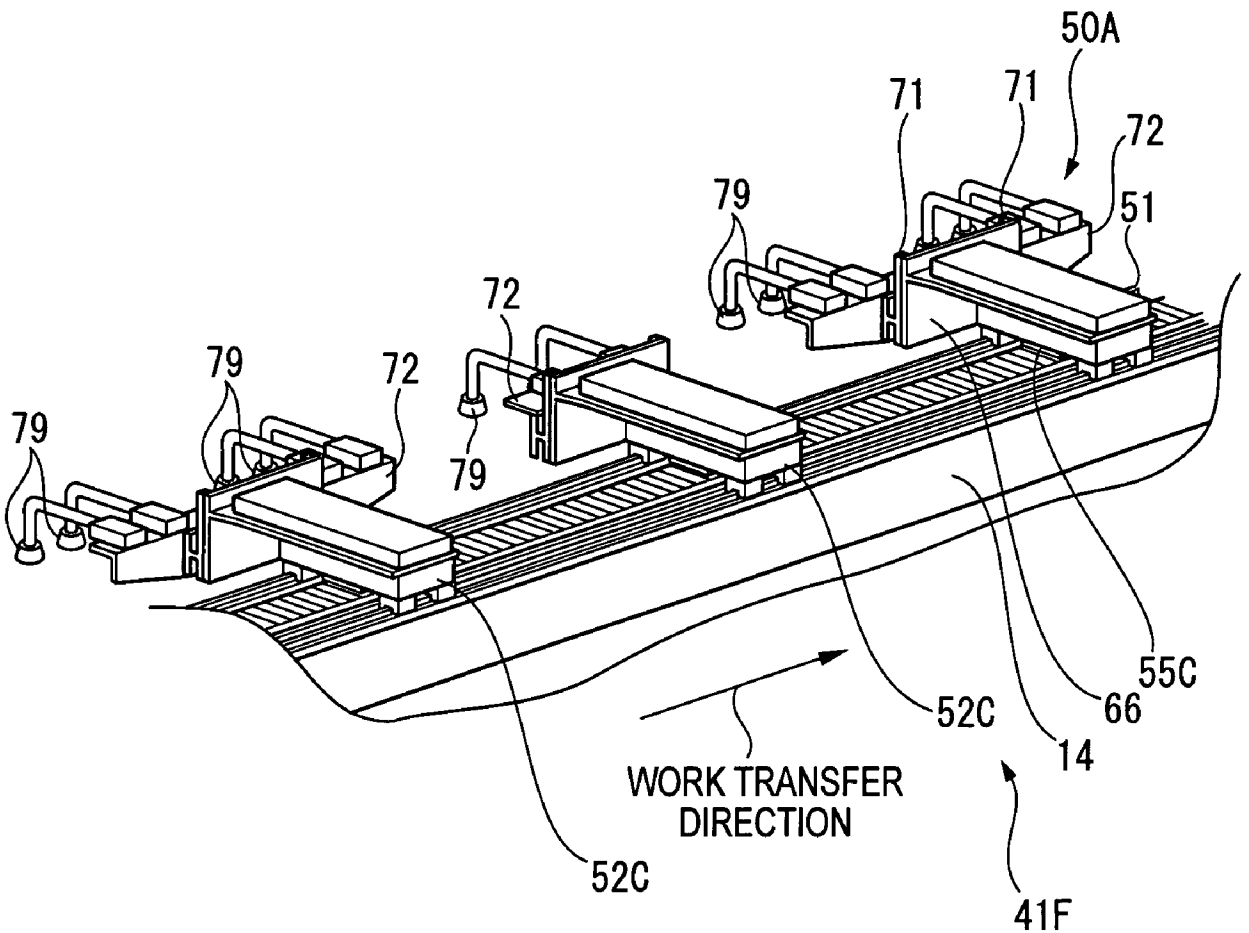
FIG. 26 is a perspective view showing a modification of the work carrying device of the pressing machine of the present invention.
Figure 27:
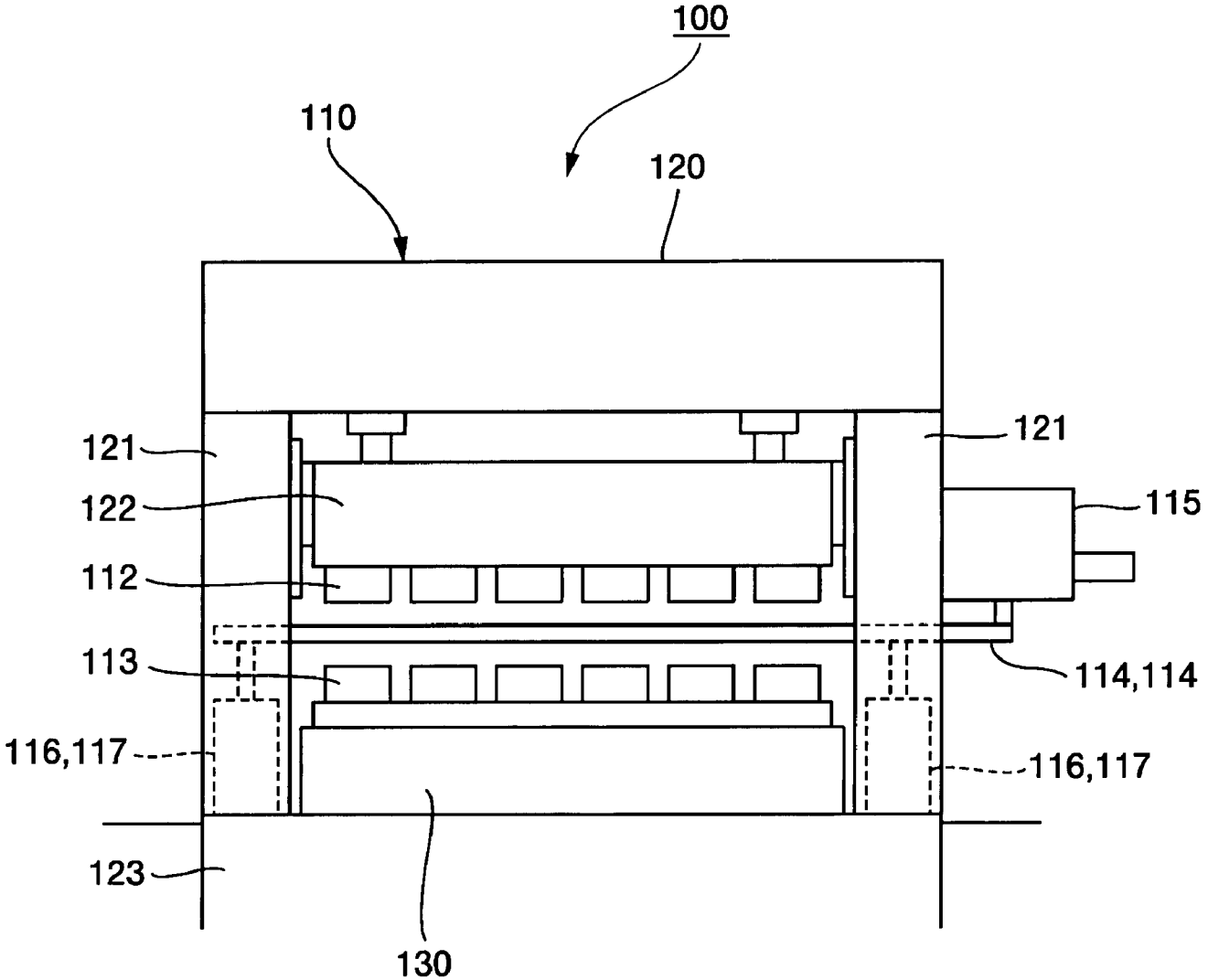
FIG. 27 is a front elevational view showing a conventional pressing machine.

Incidentally, though the vacuum cups 79 as work holders are installed to the cross bar 78 in the seventh embodiment, the vacuum cups 79 can also be installed to the lift carrier 72 as shown in FIG. 26.

Further, in the seventh embodiment, the clamping linear motor 63 is eliminated compared to the fourth embodiment, but the configuration also can be the one in which the configuration is the same as the fourth embodiment but with the drive of the clamping linear motor 63 stopped so that the cross bar 78 and the vacuum cups 79 perform two-dimensional operation.

Also, though either linear motors or servomotors are employed for the respective drive mechanisms in the previous embodiments, a combination of the linear motor and servomotor can also be employed. For example, the work holder can be moved by using a linear motor to perform the feed motion and a servomotor to perform the lift motion and the clamp motion, and at least one driving source is linear motor. Also, the work holder can be moved by using servomotor to perform the feed motion and linear motor to perform the lift motion and the clamp motion, and at least one drive mechanism is servomotor. In other words, the linear motor and the servomotor can be used as the drive mechanism for feeding, clamping, and lifting according to necessity.

Incidentally, though the above description is based on a so called two-pillar type transfer press which has four uprights and one slide, the present invention also can be applied to a pressing machine such as a so called three-pillar type transfer press which has six uprights and two slides, or other transfer press which has more uprights and slides.

Incidentally, the effects of the work carrying device of pressing machine according to the present invention also can be obtained in retrofitting.

As a recent trend in the field of the pressing machine, retrofitting of the pressing machine is actively performed, such as retrofitting an existing pressing machine by changing a cam-actuated work carrying device thereof with a servomotor-actuated device, so that the function of the pressing machine can be improved in terms of speed, capability for coping with various works, and the like.

However, when performing such a retrofitting work, it is necessary to change the feed box, which is a main part of the feed device, projected from the lateral surface of the press main body on the work carrying-out side (or the work carrying-in side). Since the feed box is large and heavy, and since the feed box is projected from the lateral surface of the pressing machine body, a number of working days will be necessary for exchanging the feed box (including the work for welding a feed box mounting seat onto the pressing machine body).

Since the operation of the process line has to be stopped for long time to perform such retrofitting work, the retrofitting work is usually performed during a long-term holiday such as New Year's holiday. However in the case that more construction days become necessary for perform the retrofitting work, the operation of the process line has to be stopped even in the period before or after such a long-term holiday, therefore the users, who do not want the operation of the process line to be stopped for long time, can not be satisfied.

However, according to the present invention, since the feed carrier is movably provided on the bar, the object to be driven by the feed drive mechanism can be made small, thus the feed drive mechanism can be made small. Accordingly, if the retrofitting is performed by adopting the work carrying device of pressing machine according to the present invention, since the existing large-scale feed box is simply removed, instead of being changed with a new large-scale feed box, a big construction work will be unnecessary. Thus the retrofitting work can be finished in few days by an easy construction work in which a size-reduced feed device is assembled with the lift device and the clamp device in advance, and then the assembly is exchanged with the old one.

Since the operation of the process line is stopped for shorter time, the retrofitting work can be finished within a long-term holiday such as New Year's holiday, thus the production plan of the users will not be affected. In other words, working days for retrofitting can be reduced, and impact to production efficiency of the user can be minimized.

Also, though the preferred configurations, methods and the like for carrying out the present invention are described above, the present invention is not intended to be limited thereto. In other words, though the present invention is mainly illustrated and described based on specific embodiment thereof, it should be understood that various changes in the shape, material, quantity, and other details of construction can be made by those skilled in the art based on the embodiment described above without departing from the spirit and objects of technical characteristics of the present invention.

Accordingly, the description disclosed above, which gives specific shape, material and the like, is just an exemplary description to make the present invention well understood instead of being a definition of the limits of the invention, therefore the description based on a component name without part or all of the specific shape, material and the like is included in the present invention.

INDUSTRIAL APPLICABILITY

With the work carrying device of pressing machine as described in present invention, since a large driving mechanism is not necessary, the construction can be simplified. Further, since the work carrying device is arranged in its entirety on the moving bolster, die exchanging can be easily performed. Accordingly, the present invention also can be applied to a pressing machine which mounts various kind of dies.

The invention claimed is:

1. A work carrying device of a pressing machine, comprising:

frames provided on both sides of a moving bolster in a work transfer direction;

a pair of bars provided in parallel in the work transfer direction;

a plurality of feed carriers provided on the bars and movable along each of the bars;

a plurality of feed drive mechanisms, each provided on one of the bars and driving the feed carriers provided on that bar along that bar in the work transfer direction;

a lift drive mechanism provided in each of the frames, the lift drive mechanism driving the pair of bars in a lift direction so that the bars move vertically;

a clamp drive mechanism provided in each of the frames, the clamp drive mechanism driving the pair of bars in a clamp direction perpendicular to the work transfer direction; and a work holder detachably connected to the feed carrier for holding a work object.

2. The work carrying device of pressing machine according to claim 1, wherein the feed drive mechanism comprises a linear motor.

3. The work carrying device of pressing machine according to claim 1, wherein the feed drive mechanism comprises a servomotor.

4. The work carrying device of pressing machine according to claim 1, wherein a plurality of the work holders for plural working processes are detachably connected to the feed carrier.

5. The work carrying device of pressing machine according to claim 1, wherein the pair of bars include fixed bars supported by the lift drive mechanism, and movable bars that are detachable from the fixed bars.

6. The work carrying device of pressing machine according to claim 1, wherein a plurality of the feed carriers are held by each of the bars, and motion of the feed carriers is controlled such that each of the feed carriers is able to move in a different manner than others of the feed carriers.

7. The work carrying device of pressing machine according to claim 1, wherein a plurality of the feed carriers are held by each of the bars, and wherein at least one connector connects adjacent ones of the plurality of the feed carriers to each other.

8. The work carrying device of pressing machine according to claim 1, wherein the pair of bars include fixed bars supported by the clamp drive mechanism, and movable bars that are detachable from the fixed bars.

* * * * *